US006146801A

United States Patent [19]

Ichikawa et al.

[11] Patent Number: 6,146,801

[45] Date of Patent: Nov. 14, 2000

[54] RESIN-COATED CARRIER, TWO COMPONENT TYPE DEVELOPER, AND DEVELOPING METHOD

[75] Inventors: Yasuhiro Ichikawa, Shizuoka-ken; Tetsuya Ida, Moriya-machi, both of Japan

[73] Assignee: Canon Kabushiki Kaisha, Tokyo, Japan

[21] Appl. No.: 09/407,294

[22] Filed: Sep. 29, 1999

[30] Foreign Application Priority Data

| | | | |
|---|---|---|---|
| Sep. 30, 1998 | [JP] | Japan | 10-276691 |
| Sep. 30, 1998 | [JP] | Japan | 10-276692 |
| Sep. 24, 1999 | [JP] | Japan | 11-270329 |

[51] Int. Cl.[7] ..... G03G 9/10

[52] U.S. Cl. ..... 430/106.6; 430/108

[58] Field of Search ..... 430/106.6, 108, 430/111

[56] References Cited

U.S. PATENT DOCUMENTS

| | | | |
|---|---|---|---|
| 2,297,691 | 10/1942 | Carlson | 430/55 |
| 3,666,363 | 5/1972 | Tanaka et al. | 355/17 |
| 4,071,361 | 1/1978 | Marishima | 96/1.4 |
| 5,512,402 | 4/1996 | Okado et al. | 430/106.6 |
| 5,512,404 | 4/1996 | Okado et al. | 430/106.6 |
| 5,573,880 | 11/1996 | Mayama et al. | 430/108 |
| 5,766,814 | 6/1998 | Baba et al. | 430/108 |
| 6,001,525 | 12/1999 | Ida et al. | 430/106.6 |
| 6,026,260 | 2/2000 | Aita et al. | 430/106.6 |

FOREIGN PATENT DOCUMENTS

| | | |
|---|---|---|
| 42-23910 | 11/1967 | Japan . |
| 43-24748 | 10/1968 | Japan . |
| 58-023032 | 2/1983 | Japan . |
| 58-144839 | 8/1983 | Japan . |
| 61-204646 | 9/1986 | Japan . |
| 2-000877 | 1/1990 | Japan . |
| 5-019632 | 1/1993 | Japan . |
| 7-098521 | 4/1995 | Japan . |
| 8-095386 | 4/1996 | Japan . |
| 9-319161 | 12/1997 | Japan . |
| 10-039549 | 2/1998 | Japan . |

OTHER PUBLICATIONS

Database WPI, Section Ch, Week 1998–07, Derwent Publ., AN 1998–067445 XP–002125645 for JP 09–305026.

Database WPI, Section Ch, Week 1993–04, Derwent Publ., AN 1993–031429 XP–002125646 for JP 04–358167.

*Primary Examiner*—John Goodrow

*Attorney, Agent, or Firm*—Fitzpatrick, Cella, Harper & Scinto

[57] ABSTRACT

A resin-coated carrier for two component type developers, with carrier particles having a carrier core material and a coat layer which covers the surface of the carrier core material. The resin-coated carrier has a 50% particle diameter C ($D_{50}$) from 25 $\mu$m to 70 $\mu$m, contains carrier particles smaller than 22 $\mu$m in particle diameter in an amount from 0.1% by number to 20% by number and contains carrier particles of 62 $\mu$m or larger in particle diameter in an amount from 2% by number to 35% by number. The carrier core material has a BET specific surface area SW1 where the coat layer has been removed and the resin-coated carrier has a BET specific surface area SW2. The SW1 and SW2 satisfy the following expression (I), and the resin-coated carrier satisfies a shape factor SF-1 of the following expression (II) and a shape factor SF-2 of the following expression (III):

$$80 \leqq SW1-SW2 \leqq 650 (cm^2/g) \quad (I)$$

$$110 \leqq SF\text{-}1 \leqq 160 \quad (II)$$

$$105 \leqq SF\text{-}2 \leqq 150 \quad (III)$$

74 Claims, 1 Drawing Sheet

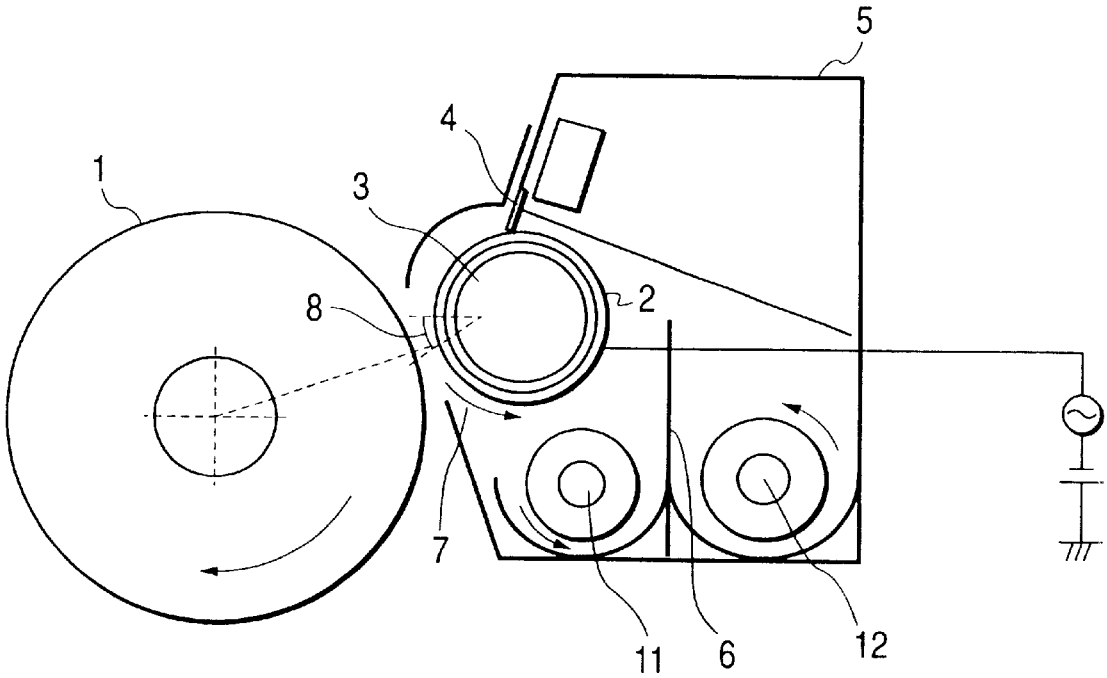
5
4
1
3
2
8
7
11
6
12

RESIN-COATED CARRIER, TWO COMPONENT TYPE DEVELOPER, AND DEVELOPING METHOD

BACKGROUND OF THE INVENTION

1. Field of the Invention

This invention relates to a resin-coated carrier for two component type developers used when latent images are developed by electrophotography or electrostatic recording, a two component type developer having such a carrier, and a developing method making use of the carrier.

2. Related Background Art

A number of methods as disclosed in U.S. Pat. No. 2,297,691, Japanese Patent Publications No. 42-23910 (U.S. Pat. No. 3,666,363) and No. 43-24748 (U.S. Pat. No. 4,071, 361) are conventionally known as electrophotography. In general, copies are obtained by forming an electrostatic latent image on a photosensitive member by utilizing a photoconductive material and by various means, subsequently developing the latent image by the use of a developer to form a visible image as a toner image, and transferring the toner image to a transfer medium such as paper when necessary, followed by fixing with heat and/or pressure.

The developer used here includes two component type developers comprised of toners and carriers, and one component type developers making use of toners alone as exemplified by magnetic toners. The two component type developers allot to the carrier the function to agitate, transfer and electrostatically charge the developer so as to be functionally separated as the developer. Hence, they have a good controllability, and are in wide use at present. In particular, developers making use of resin-coated carriers comprising a carrier core material whose surface has been coated with a resin can make resistance optimum, have an excellent charge controllability and can relatively easily be improved in qualities, such as environmental dependence or stability with time.

As core material particles, ferrite particles are widely used because of, e.g., light weight, excellent fluidity and superior controllability for magnetic properties. As developing methods, cascade development was used formerly, but magnetic brush development making use of a magnetic roll as a developer carrying member is prevalent at present. A developing apparatus employing this magnetic brush development usually has a developing sleeve which is a cylindrical developer carrying member provided internally with a magnetic roller comprising a magnetic body having a plurality of magnetic poles. On the surface of this developing sleeve, a magnetic carrier having a toner attracted thereto is carried is transported to a developing zone to make development. Also, in this magnetic brush development, it is common to apply an AC electric field to the developing bias in order to improve development efficiency.

In addition, in recent years, a technique has made progress in which, in the course of the formation of electrostatic latent images on a photosensitive member, a small-diameter laser beam is used to expose the photosensitive member. This has made the electrostatic latent images more minute. Concurrently therewith, toner particles and carrier particles are both being made smaller in diameter so that electrostatic latent images can faithfully be developed to achieve a higher image quality. In particular, it is often attempted to to decrease the average toner particle diameter to improve image quality.

Making the toner's average particle diameter smaller is an effective means for further improving image characteristics, in particular, graininess and character reproducibility, but has problems to be solved with regard to specific image quality items.

In the first place, the use of toner over a long period of time causes carrier contamination, i.e., "toner-spent", resulting in a lowering of electric charge that cause fog and toner scatter conspicuously. Such a phenomenon tends to be caused by making the toner's average particle diameter smaller. This phenomenon tends to be more pronounced when picture element units of electrostatic latent images are made minute.

Second, in instances where originals having a high image area percentage are used, there may be a time lag until the toner becomes uniformly charged when supplied in a large quantity, which is a phenomenon due to a decrease in fluidity caused by making the toner have a smaller particle diameter. Such a phenomenon, which causes faulty images, is pronounced especially when multi-color superimposed images are formed using a two component type developer, and must be prevented. This problem has long been discussed in studies on carrier resistance, but it has not yet been solved.

Triboelectric charging is made to occur by physical external force such as contact or collision of the toner with or against the carrier, and hence both the toner and the carrier may inevitably be damaged. For example, as for the toner, any external additive added to its particle surfaces may become buried in toner particles, or toner components may come off. As for the carrier, it may become contaminated by toner components inclusive of any external additive or, in the case of the resin-coated carriers, the carrier coat component may wear or break. Such damage makes it impossible to maintain the initial performances of developers with repetition of copying and causes ground fog, in-machine contamination, and variations of image density.

To solve these problems, it is attempted to use the carrier in a large quantity. Under existing circumstances, however, carriers having a sufficient durability have not been obtained.

In the two component type developing system, as disclosed in Japanese Patent Application Laid-Open No. 5-19632, a method is proposed in which the developing sleeve is made to have a large surface roughness to improve toner transport performance.

If, however, the developing sleeve merely has a large surface roughness, the sleeve surface may be scraped as a result of its friction with the developer or the toner may become buried in the uneven surface, resulting in a poor durability. If, on the other hand, the developing sleeve surface is made to merely have release properties in order to prevent it from contamination by toner, the surface tends to be so slippery as to have a poor transport performance, making it difficult for the developer to be stably fed to the developing zone. This may cause a local increase or decrease in toner concentration (i.e., toner-carrier mixing ratio) on the developing sleeve, tending to result in blurred images or non-uniform image density. If, on the other hand, the developing sleeve surface is formed of a hard metal, the coat material on the carrier particle surfaces tends to come off to accelerate carrier deterioration. Also, the use of a toner having a good fluidity may cause a decrease in frictional resistance to the developing sleeve, so that the developer may slip off and not be well transported and the developer may stagnate at the lower part of the developing sleeve, tending to cause a developer leak. Such a developer leak can not fundamentally be settled only by merely improving the mechanism of developing assemblies, thus there arises a problem that the transport performance attributable to the developing sleeve must further be improved.

Moreover, in recent years, there is an increasing commercial demand for copying machines achieve a higher minuteness and making images have a higher quality. In the present technical field, it is attempted to make toner particle diameter smaller so that color images can be formed in a high image quality. Making the particle diameters of toner smaller, however, results in an increase in the surface area per unit weight, tending to bring about a large charge quantity of the toner. This is accompanied with a possibility of the insufficiency of image density or the deterioration of running performance.

When copies of an original having a large image area percentage are continuously made on many copy sheets, sharp images with a good image quality can be obtained at the initial stage, but the edge effect with much fog may occur after copies have been made on several tens of thousands of sheets, resulting in images having poor gradation and sharpness. In this regard, the transport performance of a developer on a developing roller is very important.

Reports hitherto made for the purpose of maintaining a high image quality are exemplified by Japanese Patent Application Laid-Open No. 2-877, which discloses a toner containing toner particles with a size of 5 $\mu$m or smaller in an amount of 17 to 60% by number. This shows a strong tendency to make a toner have a smaller particle diameter. In such a case, when originals requiring a large toner consumption as in photograph originals are continuously copied, the particle size distribution of toner may change if measures are taken only from the direction of toners, making it difficult to always obtain stable images.

Meanwhile, Japanese Patent Applications Laid-Open No. 51-3238, No. 58-144839 and No. 61-204646 suggest average particle diameter and particle size distribution of carriers. Of these, Japanese Patent Application Laid-Open No. 51-3238 makes reference to a rough particle size distribution. Also, Japanese Patent Application Laid-Open No. 58-23032 discloses a carrier comprising a porous material with many voids. Such a carrier, however, tends to cause toner-spent, and does not necessarily satisfy the running stability. Japanese Patent Application Laid-Open No. 8-95386 reports a carrier at a development position and the surface roughness of a developing sleeve. Taking such measures only, however, the carrier can not stably impart triboelectricity, and does not necessarily satisfy the running stability.

Japanese Patent Application Laid-Open No. 7-98521 reports the particle size distribution and specific surface area of a carrier. This, however, is still insufficiently adaptable to high speed copying.

Nowadays, copying machines are long expected to have the ability to continuously copy a graphic picture having an image area percentage of 20% or more and the ability to lessen the edge effect and retain the uniformity of image density of a copy on one sheet.

Japanese Patent Application Laid-Open No. 9-319161 discloses that, with regard to a carrier comprising a core material having thereon a resin coat layer formed of a matrix resin in which specific thermosetting fine resin particles have been dispersed and incorporated, the core material may have shape factors SF-1 of from 100 to 145 and SF-2 of from 100 to 120, whereby uniform coatings can be formed with ease at the time of resin coating, the distribution of electric charges in toner can be made narrow and also the toner can be kept from its impaction, so that the ability to impart triboelectricity to toner can be maintained with stability.

However, in the carrier disclosed in this publication, the particle size distribution of the carrier having the resin coat layer formed thereon is not controlled, and a further improvement should be made in respect of the prevention of carrier adhesion to and carrier scatter on the photosensitive member.

In Japanese Patent Application Laid-Open No. 10-39549, with regard to a magnetic coated carrier comprising magnetic carrier core particles containing metal oxide particles and whose particle surfaces have been coated with a resin composition, various physical properties of the magnetic carrier core particles and magnetic coated carrier are specified. In particular, it discloses that the magnetic coated carrier may have a number-average particle diameter of from 1 to 100 $\mu$m and the distribution cumulative value of number distribution of particles not larger than ½-fold diameter of number-average particle diameter may be 20% by number or less, whereby the carrier adhesion can well be prevented, and also the magnetic coated carrier may have a shape factor SF-1 of from 100 to 130, whereby the developer can have a good fluidity and has a superior ability to impart triboelectricity to toner, the shape of magnetic brush can be uniform at development poles and images with a high image quality can be obtained.

However, in the carrier disclosed in this publication, any surface properties of the carrier core material are not taken into account, and there is room for further improvement in respect of developer transport performance and prevention of carrier scatter.

In conventional processes for producing carriers, it is prevalent to adjust the carrier resistance. More specifically, this is done to make the apparent resistance uniform by coating particles with resin in a large quantity in respect of a core material having a large surface unevenness, having a large specific surface area, and on the other hand by coating particles with resin in a small quantity in respect of a core material having a small surface unevenness, having a small specific surface area.

However, as discussed previously, there is an increasing commercial demand for achieving a higher minuteness and a higher image quality, and it is attempted to make toner particle diameter smaller and to merely make carriers have a small diameter for the purpose of an improvement of development efficiency. Thus, the situation is such that a deflection of materials is no longer tolerable, and it is sought to find a factor that holds the key of making the deflection of materials small. None of the previously disclosed copying machines can attain the image quality high enough to cope with the running. Under existing circumstances, it is difficult to achieve all the high image density, the high image quality and prevent fog and carrier adhesion.

SUMMARY OF THE INVENTION

An object of the present invention is to provide a resin-coated carrier for two component type developers which has solved the problems discussed above, and to provide a two component type developer having such a carrier and a developing method making use of the carrier.

More specifically, an object of the present invention is to provide a resin-coated carrier for two component type developers which is able to maintain a stable charge quantity to obtain copies with a stable image quality without causing any decrease in image density and any blurred images, even when used continuously for a long time, and to provide a two component type developer having such a carrier and a developing method making use of the carrier.

Another object of the present invention is to provide a resin-coated carrier for two component type developers which may hardly cause deterioration and has greatly been improved in running performance, even when high-speed development is performed, and to provide a two component type developer having such a carrier and a developing method making use of the carrier.

Still another object of the present invention is to provide a resin-coated carrier for two component type developers which enables reduction of the required carrier quantity and enables miniaturization of developing assemblies, and to provide a two component type developer having such a carrier and a developing method making use of the carrier.

A further object of the present invention is to provide a resin-coated carrier for two component type developers which promises quick rise of triboelectric charging between the toner and the carrier, and to provide a two component type developer having such a carrier and a developing method making use of the carrier.

To achieve the above objects, the present invention provides a resin-coated carrier for two component type developers, comprising;

carrier particles having a carrier core material and a coat layer which covers the surface of the carrier core material;

the resin-coated carrier having a 50% particle diameter C ($D_{50}$) of from 25 $\mu$m to 70 $\mu$m, containing carrier particles smaller than 22 $\mu$m in particle diameter in an amount of from 0.1% by number to 20% by number and containing carrier particles of 62 $\mu$m or larger in particle diameter in an amount of from 2% by number to 35% by number; and the carrier core material having a BET specific surface area SW1 where the coat layer has been removed and the resin-coated carrier having a BET specific surface area SW2, the SW1 and SW2 satisfying the following expression (I), and the resin-coated carrier satisfying a shape factor SF-1 of the following expression (II) and a shape factor SF-2 of the following expression (III).

$$80 \leqq SW1-SW2 \leqq 650(cm^2/g) \quad (I)$$

$$110 \leqq SF\text{-}1 \leqq 160 \quad (II)$$

$$105 \leqq SF\text{-}2 \leqq 150 \quad (III)$$

The present invention also provides a two component type developer comprising a toner and a resin-coated carrier;

the resin-coated carrier comprising carrier particles having a carrier core material and a coat layer which covers the surface of the carrier core material;

the resin-coated carrier having a 50% particle diameter C ($D_{50}$) of from 25 $\mu$m to 70 $\mu$m, containing carrier particles smaller than 22 $\mu$m in particle diameter in an amount of from 0.1% by number to 20% by number and containing carrier particles of 62 $\mu$m or larger in particle diameter in an amount of from 2% by number to 35% by number; and the carrier core material having a BET specific surface area SW1 where the coat layer has been removed and the resin-coated carrier having a BET specific surface area SW2, the SW1 and SW2 satisfying the following expression (I), and the resin-coated carrier satisfying a shape factor SF-1 of the following expression (II) and a shape factor SF-2 of the following expression (III).

$$80 \leqq SW1-SW2 \leqq 650(cm^2/g) \quad (I)$$

$$110 \leqq SF\text{-}1 \leqq 160 \quad (II)$$

$$105 \leqq SF\text{-}2 \leqq 150 \quad (III)$$

The present invention still also provides a developing method comprising the steps of;

rotating a developing sleeve carrying thereon a two component type developer having a toner and a carrier; and developing an electrostatic latent image formed on the surface of a photosensitive member, by the use of the toner of the two component type developer;

wherein a resin-coated carrier comprising carrier particles having a carrier core material and a coat layer which covers the surface of the carrier core material is used as the carrier;

the resin-coated carrier having a 50% particle diameter C ($D_{50}$) of from 25 $\mu$m to 70 $\mu$m, containing carrier particles smaller than 22 $\mu$m in particle diameter in an amount of from 0.1% by number to 20% by number and containing carrier particles of 62 $\mu$m or larger in particle diameter in an amount of from 2% by number to 35% by number; and the carrier core material having a BET specific surface area SW1 where the coat layer has been removed and the resin-coated carrier having a BET specific surface area SW2, the SW1 and SW2 satisfying the following expression (I), and the resin-coated carrier satisfying a shape factor SF-1 of the following expression (II) and a shape factor SF-2 of the following expression (III).

$$80 \leqq SW1-SW2 \leqq 650(cm^2/g) \quad (I)$$

$$110 \leqq SF\text{-}1 \leqq 160 \quad (II)$$

$$105 \leqq SF\text{-}2 \leqq 150 \quad (III)$$

BRIEF DESCRIPTION OF THE DRAWINGS

FIGURE is a cross-sectional illustration of an example of a developing apparatus used in the present invention.

DESCRIPTION OF THE PREFERRED EMBODIMENTS

The present inventors made extensive studies on technical subjects such as "achievement of higher image quality of images to be formed", "charge-providing performance to toner, and developing performance attributable to the toner coming away from carrier at the time of development", "carrier adhesion to the photosensitive member", "carrier scatter" and "durability of resin-coated carrier". As a result, they have discovered that the above technical subjects can be settled by;

making the carrier have a 50% particle diameter as small as from 25 to 70 $\mu$m so that the image quality can be improved, and contain carrier particles smaller than 22 $\mu$m in particle diameter in an amount of from 0.1 to 20% by number and contain carrier particles of 62 $\mu$m or larger in particle diameter in an amount of from 2 to 35% by number to have a sharp particle size distribution so that the carrier adhesion and carrier scatter, which are problems encountered by carriers having small particle diameter, can be kept from occurring;

controlling the shape of the resin-coated carrier to have a shape factor SF-1 of from 110 to 160 and a shape factor SF-2 of from 105 to 150 so that the fluidity of two component type developers that is problematic in carriers having small particle diameter can be kept from lowering, to improve the rise of charging of the toner; the shape factors indicating that the carrier particles are close to spheres and also their surfaces have less unevenness; and, in addition;

setting the difference between BET specific surface area SW1 of a carrier core material where the coat layer has been removed and BET specific surface area SW2 of the resin-coated carrier to be from 80 to 650 $cm^2/g$, i.e., employing a carrier core material having a smooth surface and forming the coat layer so as to be able to maintain this surface properties also on the particle surfaces of the resin-coated carrier so that the transport performance of toner and charge-providing performance to toner can be improved.

More specifically, in the resin-coated carrier of the present invention;

(a) since the resin-coated carrier has a 50% particle diameter of from 25 to 70 $\mu$m, the magnetic brush formed on the developing sleeve by the two component type developer can be so dense as to enable development true to the latent image, and hence images with a high image quality can be formed, but on the other hand such a carrier having small particle diameter tends to cause carrier adhesion to and carrier scatter on the photosensitive member, and also may make the developer have a low fluidity to cause a lowering of developing performance or a slow rise of charging of toner, bringing about further problems to be solved. However;

(b) since the resin-coated carrier contains carrier particles smaller than 22 $\mu$m in particle diameter in an amount of from 0.1 to 20% by number and contains carrier particles of 62 $\mu$m or larger in particle diameter in an amount of from 2 to 35% by number, it has a sharp particle size distribution and the carrier adhesion and carrier scatter, which are problems encountered by carriers having small particle diameter, can be kept from occurring, to improve the rise of charging of the toner. Also;

(c) since the resin-coated carrier has a shape factor SF-1 of from 110 to 160 and a shape factor SF-2 of from 105 to 150, the carrier particles are close to spheres in shape and also their surfaces are less uneven, and hence the fluidity of two component type developers that is problematic in carriers having small particle diameter can be kept from decreasing, to improve the rise of charging of the toner. Still also;

(d) since the difference between BET specific surface area SW1 of a carrier core material where the coat layer has been removed and BET specific surface area SW2 of the resin-coated carrier is set to be from 80 to 650 $cm^2/g$, i.e., since this means that a carrier core material having a smooth surface is used and the coat layer is forming so as to be able to maintain this surface properties also on the particle surfaces of the resin-coated carrier, the transport performance of toner and charge-providing performance to toner can be improved.

Thus, because of combination of these features, the resin-coated carrier of the present invention contributes to the formation of high-quality images having a high image density and free of fog from the initial stage and even after running on many sheets, and also promises a good transport performance of the developer on the developing sleeve even after running on many sheets, thus any developer leak due to the developer coming off from the developing sleeve and the toner scatter in the developing assembly may hardly occur even after running on many sheets.

The present inventors have discovered that the whole particle shape and surface state of the resin-coated carrier have a great influence on the transport performance of toners and the fluidity of two component type developers.

Such whole particle shape and surface state of the resin-coated carrier can be represented by shape factors SF-1 and SF-2 based on statistical means called image analysis, which can quantitatively analyze with high precision the area, diameter maximum length and shape of carrier images observed with a microscope.

In the present invention, a resin-coated carrier having shape factors SF-1 of from 110 to 160 and SF-2 of from 105 to 150 is used. It may preferably have SF-1 of from 115 to 150 and SF-2 of from 110 to 140, and more preferably have SF-1 of from 125 to 145 and SF-2 of from 115 to 140.

The SF-1 and SF-2 indicating the shape factors as used in the present invention are obtained by sampling at random 100 particles of the carrier by the use of FE-SEM (S-800, a scanning electron microscope manufactured by Hitachi Ltd.), introducing their image information in an image analyzer (LUZEX 3; manufactured by Nireco K.K.) through an interface to analyze and calculate, the data according to the following expression. The values obtained are defined as shape factors SF-1 and SF-2.

Shape factor SF-1=$(MXLNG)^2/AREA\times\pi/4\times100$ wherein MXLNG represents an absolute maximum length of a carrier particle, and AREA represents a projected area of a carrier particle.

The shape factor SF-2 refers to a value obtained by calculating according to the following expression.

Shape factor SF-2=$(PERIME)^2/AREA\times\frac{1}{4}\pi\times100$ wherein PERIME represents a peripheral length of a carrier particle, and AREA represents a projected area of a carrier particle.

As can be seen from these definitional expressions, the SF-1 is a numerical value obtained when the square of the length of a carrier particle is divided by the projected area of the carrier particle, and the value obtained is multiplied by $\pi/4$ and is further multiplied by 100. The closer to a sphere the carrier particle is, the closer to 100 the value obtained is. On the other hand, the slenderer it is, the greater the value is. In other words, this expresses the maximum length and minimum length of a carrier particle. The SF-2 is a numerical value obtained when the square of the peripheral length of a projected image of a carrier particle is divided by the projected area of the carrier particle, and the value obtained is multiplied by $\frac{1}{4}\pi$ and is further multiplied by 100. The closer to a sphere the carrier particle is, the closer to 100 the value obtained is. The more complicated peripheral shape the carrier particle has, the greater the value is. In other words, this expresses carrier particle surface area (i.e., unevenness). When the particle is a perfect sphere, SF-1=SF-2=100.

The shape factor SF-1 indicates the degree of sphericity of carrier particles. With an increase in this numerical value, the shape changes from spherical to amorphous. SF-2 indicates the degree of unevenness or irregularity of carrier particles. With an increase in this numerical value, the surface unevenness of carrier particles increases.

If the resin-coated carrier has shape factors SF-1 larger than 160 or SF-2 larger than 150, the developer may have an unstable transport performance, resulting in a poor running performance.

A resin-coated carrier having a shape factor SF-1 smaller than 110 makes the developer have a very good transport performance, but is disadvantageous in view of the deterioration of toner particle surfaces. The reason therefor is unclear, and it is presumed that the toner tends to be subject to pressure from the carrier because of the latter's too high apparent density. When the SF-2 is within the range of from 105 to 150, the carrier can have a high fluidity and accelerate the exchange of electric charges upon its contact with the toner, bringing the toner's charge quantity to a proper charge quantity level at an early stage.

If the SF-1 is larger than 150, the developer may have an unstable transport performance as stated above, resulting in a deterioration of stability of charge quantity and stability of images. Also when the SF-2 is outside the above range, the developer can not ensure its performance as in the case of SF-1. The carrier is more improved in fluidity as it has a rounder particle shape. The same applies also to the developer in which the toner is present mixedly. Thus, the probability of contact of the toner with the carrier becomes higher as the carrier has a rounder particle shape, bringing about quicker charging. However, carrier particles close to perfect spheres have a small specific surface area and therefore are disadvantageous in respect of charge-providing performance, thus it is difficult to electrostatically charge a large quantity of toner with a small quantity of carrier. Hence, carriers having an SF-2 smaller than 105 are not preferable because such carriers, even when made of the same material, have so high an apparent density as to result in a great impact at the time of agitation. If the SF-2 is larger than 150, the developer may have an unstable transport performance as stated above and, in addition thereto, the toner-spent on carrier particle surfaces may seriously occur, resulting in a lowering of chargeability to cause fog and toner scatter.

The resin-coated carrier of the present invention has a 50% particle diameter of from 25 to 70 μm, and preferably from 30 to 55 μm, in view of readiness of charge control of the toner and blending properties to the toner. More specifically, those having a 50% particle diameter larger than 70 μm have a small specific surface area and are disadvantageous in respect of charge-providing performance to the toner. Those having a 50% particle diameter smaller than 25 μm contain too many carrier particles having small particle diameters, and may come into question in respect of carrier scatter.

The resin-coated carrier of the present invention contains carrier particles smaller than 22 μm in particle diameter in an amount of from 0.1 to 20% by number and also contains carrier particles of 62 μm or larger in particle diameter in an amount of from 2 to 35% by number, whereby the carrier adhesion to and carrier scatter on the photosensitive member can be prevented from occurring.

As a preferred particle size distribution, the resin-coated carrier may contain the carrier particles smaller than 22 μm in particle diameter in an amount of from 0.4 to 20% by number, and more preferably from 1 to 20% by number, contain carrier particles smaller than 16 μm in particle diameter in an amount not more than 3% by number, contain the carrier particles of 62 μm or larger in particle diameter in an amount of from 2 to 35% by number, and contain carrier particles of 88 μm or larger in particle diameter in an amount not more than 10% by number.

If the carrier particles smaller than 22 μm in particle diameter are in a content more than 20% by number, the carrier tends to scatter on the photosensitive member (drum) to cause faulty images. If the carrier particles smaller than 22 μm in particle diameter are in a content less than 0.1% by number, the carrier may have no sufficiently large specific surface area to become short of charge-providing performance of the carrier, tending to cause toner scatter.

If the carrier particles of 62 μm or larger in particle diameter are in a content more than 35% by number, the toner scatter may occur. If the carrier particles of 62 μm or larger in particle diameter are in a content less than 2% by number, the developer may have a poor fluidity.

Also when the carrier particles smaller than 16 μm in particle diameter are in a content more than 3% by number, the carrier tends to show the same tendency as the case when the carrier particles smaller than 22 μm in particle diameter are in a content more than 20% by number.

Also when the carrier particles of 88 μm or larger in particle diameter are in a content more than 10% by number, the carrier tends to show the same tendency as the case when the carrier particles of 62 μm or larger in particle diameter are in a content more than 35% by number.

Measurement of particle size distribution of carrier: An SRA type microtrack particle size analyzer (manufactured by Nikkiso K.K.) is used as an apparatus for measuring the particle size distribution of the carrier. The measurement range is set to be from 0.7 to 125 μm, and the 50% average particle diameter ($D_{50}$) and particle size distribution are determined.

The present inventors have also discovered that the relationship between a BET specific surface area SW1 of the carrier core material where the coat layer has been removed from the resin-coated carrier and a BET specific surface area SW2 of the resin-coated carrier is closely related to the maintenance of high image quality.

More specifically, in the present invention, the relationship between a BET specific surface area SW1 of the carrier core material where the coat layer has been removed from the resin-coated carrier and a BET specific surface area SW2 of the resin-coated carrier after coating, i.e., in the state of being used, satisfies the following expression (I). This is important in order to achieve both the transport performance and the charge-providing performance.

$$80 \leqq SW1-SW2 \leqq 650(cm^2/g) \quad (I)$$

It may preferably satisfy the following expression (IV), more preferably the following expression (V), still more preferably the following expression (VI), and most preferably the following expression (VII). This enables the achievement of a better transport performance.

$$100 \leqq SW1-SW2 \leqq 520(cm^2/g) \quad (IV)$$

$$100 \leqq SW1-SW2 \leqq 500(cm^2/g) \quad (V)$$

$$150 \leqq SW1-SW2 \leqq 450(cm^2/g) \quad (VI)$$

$$180 \leqq SW1-SW2 \leqq 400(cm^2/g) \quad (VII)$$

If the value of SW1−SW2 is less than 80, it means that the surface of the carrier core is smooth or that the coat material is in a very small quantity. The former case may result in a too large charge quantity and cause an phenomenon of image density decrease and toner deterioration. The latter case may result in faulty charging to cause background fog and toner scatter. Namely, when the particle surface of the carrier is too smooth, the toner tends to be affected by collision between carrier particles at the time of agitation, resulting in a too large charge quantity and also tending to cause toner deterioration. If the value of SW1−SW2 is more than 650, the coat material is present in excess on the irregularities of the carrier core material, tending to lower a developer transport performance and also to cause toner scatter.

In the present invention, the BET specific surface area SW1 of the carrier core material where the coat layer has been removed from the resin-coated carrier may preferably be from 600 to 1,300 $cm^2/g$, more preferably be from 700 to 1,050 $cm^2/g$, and still more preferably be from 830 to 960 $cm^2/g$.

If the SW1 is larger than 1,300 $cm^2/g$, the coating material may come into concavities to make it difficult for the coating material uniformly to be present on the particle surfaces, tending to make charging performance non-uniform. If it is smaller than 600 $cm^2/g$, the particle surfaces are so excessively smooth that the coat layer may have a low adhesion to tend to cause a problem in running performance.

In the present invention, the BET specific surface area SW2 of the resin-coated carrier may preferably be from 450 to 1,000 $cm^2/g$, more preferably be from 500 to 900 $cm^2/g$, and still more preferably be from 500 to 700 $cm^2/g$.

If the SW2 is larger than 1,000 $cm^2/g$, the condition of carrier particle surfaces and condition of coatings lack smoothness to tend to cause a problem in the developer transport performance, and cause developer leak in some cases. If it is smaller than 450 $cm^2/g$, the carrier particles have so small a specific surface area as to lower the charge-providing performance, tending to cause toner scatter.

To remove the coat layer from the resin-coated carrier, the resin-coated carrier is heated to 850° C. in the air and then cooled, followed by washing with a solvent (methyl ethyl ketone).

The BET specific surface area of the resin-coated carrier and carrier core material is shown as a value measured by single-point determination using a BET specific surface area measuring equipment (FLOW SORB II2300, manufactured by Shimadzu Corporation).

The resin-coated carrier of the present invention comprises a carrier core material whose surface has been covered with a coat layer having at least a resin.

As the carrier core material (carrier core particles) used in the resin-coated carrier, magnetic particles such as iron, magnetite or ferrite particles may be used. In particular, ferrite particles may preferably be used.

In the resin-coated carrier of the present invention, the value of SW1 in the present invention can be controlled by modifying surface properties of the carrier core particles. The ferrite particles, a carrier core material used in the present invention, are obtained usually by mixing materials and optionally making calcination and pulverization, followed by firing. In order to modify surface properties of the particles, the temperature at the time of firing may be changed. The SW1 may also be controlled by changing the firing atmosphere or carrier formulation or by introducing an additive such as a metal oxide. There are no particular limitations.

Stated specifically, e.g., like ferrite particles produced in Examples described later, in the production of ferrite particles, the firing may preferably be carried out at a temperature, which is conventionally 900° C. or below, set higher to be from 1,050° C. to 1,300° C. Also, in order to accelerate crystal growth, the firing may preferably be carried out for a time of from 4 to 9 hours, which is twice or three times the conventional firing time of 2 to 3 hours. Still also, in order to prevent particles from coalescing mutually and make particles less different in size, it is preferable to carry out multi-stage firing in which firing first carried out at a low temperature to cause disintegration is further followed by main firing carried out at a high temperature.

In the present invention, in order to control the value of SW1 and to control volume specific resistance value of the resin-coated carrier, the ferrite particles may preferably have a composition represented by the following general formula:

$$(MnO)_x(MgO)_y(Fe_2O_3)_z$$

wherein x+y+z=100 mole %. Part of MnO, MgO and $Fe_2O_3$ is substituted with at least SrO or $SnO_2$, the ferrite particles may more preferably satisfy 9 mole % $\leqq$ x+y+z $\leqq$ 100 mole %.

Using as the carrier core material the ferrite particles the value of SW1 of which has been controlled by modifying their shape and surface properties, the coat layer may be formed on this carrier core material while controlling various conditions such as the composition of the resin constituting the coat material (coating resin), the thickness of the coat layer and the manner of forming the coat layer, thus the resin-coated carrier having the desired shape factors can be obtained.

As the coating resin used to form the coat layer in the resin-coated carrier of the present invention, thermoplastic resins and thermosetting resins of various types can be used as exemplified by polystyrene resins, polyacrylic or polymethacrylic resins, polyolefin resins, polyamide resins, polycarbonate resins, polyether resins, polysulfone resins, polyester resins, epoxy resins, polybutyral resins, urea resins, urethane resins, silicone resins and Teflon resins, and mixtures of any of these, as well as copolymers, block copolymers, graft copolymers and polymer blends of any of these resins. In order to control charging performance, resins having polar groups of various types may also be used. In order to control charge quantity and improve adhesion to the core material, coupling agents of various types may also be used.

In the present invention, in view of charge-providing performance to the toner and adhesion to the carrier core material, it is preferable to use silicone resins.

A silicone resin (alkoxysiloxane) represented by the following general formula (I) is preferred.

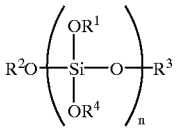

(I)

wherein $R^1$, $R^2$, $R^3$ and $R^4$ each represent an alkyl group, and n represents an integer of 2 or more.

In the alkoxysiloxane represented by the above general formula (I), specific examples of the groups $R^1$ to $R^4$ may preferably have 1 to 4 carbon atoms, such as a methyl group, an ethyl group, a n-propyl group, an iso-propyl group and a butyl group. Particularly preferred are methyl groups and ethyl groups, in particular, methyl groups. The integer n may preferably be from 2 to 100, and more preferably from 2 to 30, and particularly preferably from 3 to 15.

The alkoxysiloxane used in the present invention may be a mixture of alkoxysiloxanes having different integers n in the general formula (I). In such a case, the mixture may especially preferably have an average molecular weight of from 250 to 4,000, in particular, from 300 to 3,000. The alkoxysiloxane represented by the above general formula (I) can be obtained by allowing a metal silicon to react with an alcohol to synthesize a tetraalkoxysilane, and further polymerizing it.

In the present invention, it is also possible to use a modified silicone resin. Modified silicone resins such as alkyd-modified, epoxy-modified, acryl-modified, polyester-modified, phenol-modified, melanin-modified or urethane-modified can be employed.

For the purpose of improving the adhesion of resin to the carrier core material, a silane coupling agent may preferably be used in combination. As the silane coupling agent, known agents may be used. The silane coupling agent refers to an organosilicone compound having in the same molecule a functional group capable of readily reacting with an inorganic group such as $-SiX_3$ or $-SiX_2$ (wherein X represents a hydrolyzable substituent such as an alkoxyl group or a halogen group) and a functional group capable of readily reacting with an organic group such as a vinyl group, an epoxy group, an amino group, an acryloyl or methacryloyl group or a mercapto group.

As specific examples, it may include trichlorovinylsilane, trimethoxyvinylsilane, triethoxyvinylsilane, tris(2-methoxyethoxy)vinylsilane, 2-(3,4-epoxycyclohexyl) ethyltrimethoxysilane, 3-(2,3-epoxypropoxy) propyltrimethoxysilane, 3-(2,3-epoxypropoxy) propylmethyldiethoxysilane, 3-(2,3-epoxypropoxy) propyltriethoxysilane, 3-methacryloyloxypropylmethyldimethoxysilane, 3-methacryloyloxypropyltrimethoxysilane, 3-methacryloyloxypropylmethyldiethoxysilane, 3-methacryloyloxypropyltriethoxysilane, 3-(2-aminoethylamino )propylmethyldimethoxysilane, 3-(2-aminoethylamino)propyltrimethoxysilane, 3-(2-aminoethylamino)propyltriethoxysilane, 3-aminopropyltrimethoxysilane, 3-aminopropyltriethoxysilane, 3-anilinopropyltrimethoxysilane, 3-chloropropyltrimethoxysilane and 3-mercaptopropyltrimethoxysilane.

As a method of coating the resin, the coating resin may be dissolved in a solvent capable of dissolving the resin to prepare a resin solution, and this solution may be coated on the carrier core particles by wet coating such as spraying or dipping, but dry coating without a solvent may also be used. For example, in a production process in which fine resin powder adheres to the carrier core particles and is thereafter melted by heating, the shape factors can be controlled by changing particle diameter and melting conditions of the fine resin powder. There are no particular limitations on the means therefor.

The fine resin powder used in such dry coating may be of any type, without any particular limitations. Stated specifically, usable are polyolefin resins such as polyethylene and polypropylene; polyvinyl resins such as polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone, and polyvinylidene resin; vinyl chloride-vinyl acetate copolymer; styrene-acrylic acid copolymer; straight silicone resins comprised of an organosiloxane linkage, or modified products thereof; fluorine resins such as polytetrafluoroethylene, polyvinyl fluoride, polyvinylidene fluoride and polychlorotrifluoroethylene; polyester resins; polyurethane resins; polycarbonate resins; phenol resins; amino resins such as urea-formaldehyde resin, melamine resin, benzoguanamine resin, urea resin and polyamide resin; and epoxy resins.

These fine resin powders may suitably be those having an average particle diameter of from 0.05 to 5 $\mu$m, and preferably from 0.05 to 2 $\mu$m. As their particle shape, any of those that have been pulverized and made spherical may be used. The shape factors of the resin-coated carrier can also be controlled by controlling conditions for coating carrier particles, without relying only on the particle diameter of the fine resin powder.

The solvent usable in the wet coating may include, e.g., alcohols such as methanol and isopropanol, and toluene, xylene, methyl ethyl ketone and methyl isobutyl ketone.

The shape factors of the resin-coated carrier in the present invention may also be controlled by controlling the coating weight of its coat layer.

The coat layer may preferably have a coating weight of from 0.1 to 5.0% by weight, and more preferably from 0.1 to 3.3% by weight, based on the weight of the carrier core particles. If the coating weight is less than 0.1% by weight, the coating can not well be effective, resulting in a poor environmental resistance. If on the other hand the coating weight is more than 5.0% by weight, although the carrier's electrical resistance increases with an increase in the coat layer's coating weight based on the weight of the carrier core particles, a poor fluidity may result to make it impossible to control image characteristics, and also make it difficult to attain the characteristics of specific surface area of the resin-coated carrier in the present invention.

In the present invention, to determined the coating weight of the coat layer of the resin-coated carrier, the resin-coated carrier is heated to 850° C. in the air and then cooled, followed by washing with a solvent (methyl ethyl ketone), and the coating weight is determined from its weight loss percentage before and after the heating, using a thermobalance (TGA: TGA-7 Type, manufactured by Perkin-Elmer Corporation).

When the coating weight of the coat layer of the resin-coated carrier in the two component type developer is determined, it is measured on a resin-coated carrier obtained by removing the toner from the two component type developer using surface-active agent.

If the shape factor SF-2 is larger than 150, the coating weight may be too small or the unevenness of the carrier core material surface may be too large to ensure a sufficient coating thickness, so that the developer may have a low fluidity to tend to be coated on the developing sleeve non-uniformly or cause the leak of developer. At the same time, triboelectric charging rate or charging stability may be damaged to tend to cause toner scatter.

Controlling the SF-1 and SF-2 within the above ranges, good image characteristics can be sustained without damaging the fluidity and transport performance of toner and the carrier.

As a result of extensive studies on the surface properties of the developing sleeve, the present inventors have further discovered that the ratio of the average particle diameter of the carrier to average particle diameter of the toner and the surface roughness Rz of the developing sleeve have a large influence on the transport performance.

More specifically, in the present invention, in order to achieve both the transport performance and the charge-providing performance, the surface roughness Rz of the developing sleeve, and X/C, which is the ratio of toner weight-average particle diameter (D4) X to carrier 50% particle diameter C, may preferably satisfy the following expression (VIII) and may more preferably satisfy the following expression (IX).

$$2\times Rz \leqq X/C\times 100 \leqq 11\times Rz \quad \text{(VIII)}$$

$$2\times Rz \leqq X/C\times 100 \leqq 8\times Rz \quad \text{(IX)}$$

When they are within the above ranges, the frictional resistance between the toner and the developing sleeve can be increased and the developer can be transported preferably, thus the developer can be prevented from leaking at a developer collecting opening even when a toner having a good fluidity is used.

When the carrier particle diameter C is larger than the toner particle diameter X, the carrier has a relatively small specific surface area and hence the tolerance to toner scatter and fog is small. When the carrier particle diameter C is smaller than the toner particle diameter X, charging tends to lower in an environment of high-humidity.

If the value of X/C×100 is smaller than (2×Rz), a force ascribable to the carrier tends to be applied onto the developing sleeve, and hence the transport performance may so greatly change during long-term service that the toner may insufficiently be agitated to cause a decrease in toner concentration or may undergo faulty charging to tend to cause fog. If on the other hand the value of X/C×100 is larger than (11×Rz), the developer tends to slip on the developing sleeve and tend to cause toner scatter. Also, the developer tends to become uneven on the developing sleeve to cause, e.g., the filming of toner to the photosensitive member, resulting in a short lifetime of the photosensitive member. Such problems are undesirable.

The surface roughness Rz refers to ten-point average roughness, and can be measured using, e.g., Surfcorder SE-30H, manufactured by Kosaka Kenkyusho. This ten-point average roughness reflects the depth of fine irregularities on a solid surface well.

In the present invention, in order to improve the developer transport performance, the resin-coated carrier may preferably satisfy both the following expressions (IV) and (IX).

$$100 \leqq SW1-SW2 \leqq 520 (cm^2/g) \quad (IV)$$

$$2 \times Rz \leqq X/C \times 100 \leqq 8 \times Rz \quad (IX)$$

Constituted as described above, the present invention makes the frictional resistance between the carrier and the developing sleeve higher so that the developer can be preferably transported and excess charging do not occur.

As materials for the developing sleeve, there are no particular limitations thereon so long as they are those used in usual developing assemblies, and non-magnetic materials such as stainless steel, aluminum and ceramics and coated materials of these may be used. There are no particular limitations also on the shape of the developing sleeve.

In view of durability, its surface may preferably be coated with a resin. As binder resins used in such resin coat layers, commonly known resins may be used. For example, thermoplastic resins such as styrene resins, vinyl resins, polyether-sulfone resins, polycarbonate resins, polyphenylene oxide resins, polyamide resins, fluorine resins, cellulose resins and acrylic resins; and thermo- or photosetting resins such as epoxy resins, polyester resins, alkyd resins, phenol resins, melamine resins, polyurethane resins, urea resins, silicone resins and polyimide resins. In particular, preferred are those having excellent release properties, such as silicone resins and fluorine resins, and those having excellent mechanical properties, such as polyether sulfone, polycarbonate, polyphenylene oxide, polyamide, phenol, polyester, polyurethane, styrene and acrylic resins.

When coated with such a resin, it is effective to disperse particles in the resin in order to achieve much better charging stability. In particular, it is very effective to disperse conductive particles such as carbon and metal powder. Stated specifically, such particles may include commonly known fine conductive powders, as exemplified by powders of conductive metals such as copper, nickel, silver and aluminum, or alloys thereof; metal oxide type conductive agents such as antimony oxide, indium oxide, tin oxide and titanium oxide; and carbon type conductive agents such as amorphous carbon, furnace black, lampblack, thermal black, acetylene black and channel black.

In the present invention, the surface roughness Rz of the developing sleeve may be adjusted to the above range by, e.g., sand blasting, grooving, grinding, and index saver processing. Alternatively, as described above, the surface may be coated with the resin and the resin may be incorporated with a filler such as metal powder. Thus, the frictional resistance of the developing sleeve can be improved in a desirable state.

The present invention is remarkably effective when applied to a toner with a small average particle diameter, having a large surface area per unit weight.

Stated specifically, where the weight-average particle diameter (D4) is represented by X ($\mu$m) and the number-based, percent by number of toner particles of 4.00 $\mu$m or smaller in particle diameter determined from number distribution is represented by Y (% by number), the toner may have a particle size distribution wherein X and Y fulfill the following conditions:

$-4X+30 \leqq Y \leqq -16X+155$; and $3.5 \leqq X \leqq 8.5$;

and the toner may preferably fulfill the following condition:

$4.5 \leqq X \leqq 8.5$.

Making toner particles have a small particle diameter enables formation of high-quality images reproduced faithfully to electrostatic latent images. However, a fine-powder toner having a small particle diameter, e.g., 4.00 $\mu$m or smaller, has so strong an adhesion as to tend to remain on the photosensitive member without being removed by cleaning after transfer, and its toner particles may melt-adhere to the photosensitive member or, in an apparatus with a contact charging member, the toner particles may contaminate the contact charging member and cause faulty charging. It has also been found that making particle diameter smaller brings about so large a specific surface area that the toner may strongly adhere to the carrier to tend to cause faulty charging due to carrier contamination.

The toner satisfying the above particle size distribution is prevented from scattering at the time of fixing. Such toner scatter has been questioned in toners with smaller particle diameter in order to form images more faithful to originals.

X ($\mu$m) which is larger than 8.5 is not preferable because of a poor reproducibility per dot. X which is smaller than 3.5 is not preferable because the developer tends to undergo charge-up, tending to cause the problem of a decrease in image density. Y (% by number) which is smaller than $-4X+30$ is not preferable because of a poor reproducibility per dot like the case when X is larger than 8.5, resulting in a low resolution. Y (% by number) which is larger than $-16X+155$ is not preferable because much fog may occur in non-image areas or the toner may melt-adhere to the photosensitive member, or contaminate the contact charging member and cause faulty charging.

The weight-average particle diameter and particle size distribution of the toner is measured using a Coulter counter Model TA-II or Coulter Multisizer (manufactured by Coulter Electronics, Inc.). As an electrolytic solution, an aqueous 1% NaCl solution is prepared using first-grade sodium chloride. For example, ISOTON R-II (available from Coulter Scientific Japan Co.) may be used. A measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of 2 μm or larger, using Coulter counter Model TA-II, using an aperture of 100 μm. Then the values according to the present invention are determined, which are the weight-based, weight average particle diameter (D4: the middle value of each channel is used as the representative value for each channel) determined from volume distribution and the number-based proportion of particles with particle diameters of 4.00 μm or smaller determined from number distribution.

The toner used in the present invention contains at least a binder resin and a colorant.

There are no particular limitations on the type of the binder resin for the toner used in the present invention. For example, one can use homopolymers of styrene and derivatives thereof such as polystyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Cross-linked styrene resins are also preferred binder resins. It is possible to further introduce an acid component such as maleic acid, citraconic acid, itaconic acid or an alkenylsuccinic acid. The resins may be produced by known processes without any particular limitations so long as the desired molecular weight distribution is attained.

The binder resin used in the present invention may be a polymer having been cross-linked with a cross-linkable monomer as exemplified below.

The cross-linkable monomer may include, e.g., aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether bond, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.). Polyfunctional cross-linkable monomers may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate. Any of these cross-linkable monomers may preferably be used in an amount of from about 0.01 to about 5% by weight, and more preferably from about 0.03 to about 3% by weight, based on 100% by weight of other monomer components.

As colorants suited for the object of the present invention, any known dyes and pigments may widely be used, as exemplified by copper phthalocyanine, insoluble azo, disazo yellow, anthraquinone pigments, quinacridone pigments and disazo oil-soluble dyes.

Particularly preferred pigments include C.I. Pigment Yellow 17, C.I. Pigment Yellow 1, C.I. Pigment Yellow 12, C.I. Pigment Yellow 13, C.I. Pigment Yellow 14, C.I. Pigment Red 5, C.I. Pigment Red 2, C.I. Pigment Red 3, C.I. Pigment Red 17, C.I. Pigment Red 22, C.I. Pigment Red 23, C.I. Pigment Red 122, C.I. Pigment Red Blue 15, C.I. Pigment Red Blue 16, and a copper phthalocyanine pigment which is a Ba salt the phthalocyanine skeleton of which has been substituted with two or three carboxybenzamidomethyl groups.

Dyes include C.I. Solvent Red 49, C.I. Solvent Red 52 and C.I. Solvent Red 109.

Examples, however, are by no means limited to these, and colorants subjected to any surface treatment to make hydrophobic may also be used.

With regard to yellow toners, which sensitively reflect the transmission of OHP films, the colorant may be contained in an amount of 12 parts by weight or less, and preferably from 0.5 to 7 parts by weight, based on 100 parts by weight of the binder resin. If it is in an amount of more than 12 parts by weight, reproducibility may be poor in respect of green and red, which are mixing colors of yellow, and human flesh color as images.

With regard to other magenta and cyan color toners, the colorant may be contained in an amount of 15 parts by weight or less, and preferably from 0.1 to 9 parts by weight, based on 100 parts by weight of the binder resin.

Meanwhile, the toner may be incorporated with a magnetic material, which may include, e.g., magnetite, ferrite and iron oxides, and which need not necessarily be incorporated.

In the present invention, a charge control agent may optionally be present in the toner. For example, one can use metal complex salts of monoazo dyes, metal complex salts of salicylic acid, alkylsalicylic acids, dialkylsalicylic acids or naphthoic acid, Nigrosine compounds and organic quaternary ammonium salts, but the agents are not particularly limited to the above list. In order to attain a good charging performance, it may include monoazo metal compounds as effective, and may include monoazo iron complexes as preferred. Azo iron complexes can achieve desirable dispersion especially in binders having acid components, because of their intermolecular mutual action.

In the toner used in the present invention, an inorganic fine powder or a hydrophobic inorganic fine powder may be mixed in order to improve environmental stability, charging stability, developing performance, fluidity and storage stability. For example, any of fine silica powder, fine titanium oxide powder and fine aluminum oxide powder may be used alone or in combination. Especially in view of the stability of charge quantity of toner against environmental variations, it is preferable to use fine titanium oxide powder and/or fine aluminum oxide powder.

More specifically, this is because silica has a strong negative chargeability and alumina or titanium oxides have an almost neutral chargeability, and hence silica is disadvantageous in view of environmental stability.

These fine powders may preferably be subjected to a hydrophobic treatment. A treating agent may be used with a weight ranging from 0.1 to 300%, and preferably from 0.5 to 150%, based on the weight of the fine powder. Commonly available is a treating method in which the above treating agent (polymer), having been dissolved in a suitable solvent, is added to the fine powder to effect surface coating, and thereafter the solvent is removed by drying. As a specific method, the treatment may preferably be carried out using a coater such as a kneader coater, a spray dryer, a thermal processor or a fluidized-bed coater. Preferred is a method in which the fine powder is treated by hydrolyzing a coupling agent while dispersing the powder mechanically in a solution so as to have a primary particle diameter. In the present invention, it is particularly preferable to make surface treatment with two types of solvents having different solubilities of the coupling agent. Such stepwise addition of solvents in which a hydrophobic-treating agent has been dispersed in alumina fine powder is an example of a means by which the specific physical properties of the present invention can be imparted, but not limited to this means.

The fine powders may also be subjected to a hydrophobic treatment with two or more hydrophobic-treating agents. For example, two types of coupling agents such as n-$C_4H_9$—Si—$(OCH_3)_3$ and n-$C_{12}H_{25}$—Si—$(OCH_3)_3$ may be mixed and used as hydrophobic-treating agents to conduct a hydrophobic treatment, where the hydrophobic-treating agent having a small number of carbon atoms reacts with hydroxyl groups on the particle surfaces of the external additive fine powder. Next, unreacted hydroxyl groups on the particle surfaces of the fine powder reacts with the hydrophobic-treating agent having a large number of carbon atoms. Thus, the manner of adhesion of the hydrophobic-treating agents adhering to the fine powder particle surfaces can be controlled.

If necessary, after the drying, the treated product may also be pulverized, followed by classification. There are no particular limitations on conditions when such a method is employed.

In the present invention, usable hydrophobic-treating agents may include, e.g., the following: Vinyltrimethoxysilane, vinyltriethoxysilane, γ-methacryloxypropyltrimethoxysilane, and alkylmethoxysilanes such as methyltrimethoxysilane, methyltriethoxysilane, isobutyltrimethoxysilane, dimethyldimethoxysilane and octyltrimethoxysilane. It is also possible to use alkylchlorosilanes such as methyltrichlorosilane, octyltrichlorosilane and dimethyldichlorosilane, hexamethyldisilazane or silicone oil in combination.

In the present invention, particularly preferred is a coupling agent represented by the general formula:

$$C_nH_{2n+1}—Si—(OC_mH_{2m+1})_3$$

wherein n is 4 to 12 and m is 1 to 3. Here, if the n in the general formula is smaller than 4, the treatment can be made with ease but may result in an insufficient hydrophobicity. Also, if n is larger than 12, a sufficient hydrophobicity can be achieved, but particles of the external additive fine powder may much coalesce one another to cause a lowering of reactivity, resulting in a low charge-providing performance. If m is larger than 3, the reactivity may be too low to make sufficient hydrophobic treatment.

The external additive fine powder may be treated to have a hydrophobicity of from 30% to 90%. If it has a hydrophobicity lower than 30%, the charge quantity may drastically decrease as a result of long-term retention in a high humidity environment, making it necessary to provide a charge-accelerating mechanism and complicating the apparatus. If on the other hand it has a hydrophobicity higher than 90%, it may be difficult to control the charging of the external additive fine powder, resulting in charge-up of the toner in a low humidity environment.

In the present invention, inorganic fine particles or hydrophobic inorganic fine particles as mentioned above may preferably be used in an amount of from 1.0 to 10 parts by weight, and more preferably from 0.1 to 5 parts by weight, based on 100 parts by weight of the toner particles.

Additives other than the foregoing may optionally be added to the toner in the present invention.

The additives are, e.g., fine particles which act as a charge auxiliary agent, a conductivity-providing agent, a fluidity-providing agent, an anti-caking agent, a release agent used at the time of heat-roll fixing, a lubricant or an abrasive.

Preferred are lubricants as exemplified by Teflon, zinc stearate and polyvinylidene fluoride; abrasives as exemplified by cerium oxide, silicon carbide and strontium titanate; fluidity-providing agents as exemplified by titanium oxide and aluminum oxide (in particular, a hydrophobic one is preferred); anti-caking agents; conductivity-providing agents as exemplified by carbon black, zinc oxide, antimony oxide and tin oxide; and white fine particles and black fine particles having opposite polarity which may be used in a small quantity as a developing performance improver.

The external additive particles such as fine resin particles, inorganic fine particles or hydrophobic inorganic fine particles mixed with the toner particles may preferably be used in an amount of from 0.1 to 10 parts by weight, and more preferably from 0.1 to 5 parts by weight, based on 100 parts by weight of the toner particles.

The toner can be produced by, e.g., well mixing the toner constituents by means of a mixing machine, thereafter melt-kneading the resulting mixture by means of a heat kneader such as a heat roll, a kneader or an extruder, and then cooling the resulting kneaded product to solidify, followed by pulverization and classification. As other method, also usable is a polymerization process which forms toner particles in a solvent. There are no particular limitations. As a dry process, the toner can be produced by kneading and pulverization, and as a wet process, by suspension polymerization, interfacial polymerization or submerged drying. This kneading may be carried out using a known heat kneading machine, which may specifically include three-roll types, single-screw types, twin-screw types and Banbury mixer types.

Toner pulverization apparatus may include, e.g., micronizers, Ulmax, Jet-O-mizer, KTM (krypton, turbo-mills, and I-type Jet mills. After the step of pulverization, it is possible to employ the Hybridization system (manufactured by Naka Kikai Seisakusho), Mechanofusion system (manufactured by Hosokawa Micron K.K.) or the Kriptron system (manufactured by Kawasaki Heavy Industries, Ltd.).

A developing apparatus used in the present invention will be described below.

FIG. 1 cross-sectionally illustrates an example of the developing apparatus used in the present invention. In FIG. 1, reference numeral 1 denotes a photosensitive drum which is rotated in the direction of an arrow and has, on its surface, a photosensitive layer comprising Se, Cds, amorphous silicon or an organic photoconductor, and on the surface on which an electrostatic latent image is formed by the aid of a charging assembly (not shown) and an exposure means (not shown). Reference numeral 2 denotes a developing sleeve serving as a developer carrying member. Reference numeral 3 denotes a magnet roller stationarily provided inside the developing sleeve 2 and having a plurality of magnetic poles N and S in the peripheral direction. A developer is carried by the developing sleeve 2 and magnet roller 3, and the developing sleeve 2 is rotated in the direction of an arrow shown in the drawing, with respect to the stationary magnet roller 3 to transport the developer. The magnetic poles N and S of the magnet roller 3 stand magnetized at a suitable magnetic flux density, and a magnetic brush comprised of the developer is formed by the aid of the magnetic force produced. Reference numeral 4 denotes a regulation member for regulating the height and amount of the magnetic brush; and 5, a housing of the developing apparatus. Reference numerals 11 and 12 denote feed rollers which circulate the developer; 6, a partition plate; and 7, a developer collecting opening, which may cause a leak of the developer therefrom. Reference numeral 8 denotes a developing zone.

The toner supplied into the apparatus is well agitated and mixed with the carrier by means of the feed rollers 11 and 12 rotated in the direction of the arrow to effect triboelectric charging, and also sent onto the developing sleeve 2. The surface distance between the developing sleeve and the photosensitive drum 1 is set at a prescribed gap (e.g., 0.6 mm). When the electrostatic latent image on the photosensitive drum 1 is developed, the magnetic brush formed on the surface of the developing sleeve 2 is moved together with the developing sleeve while being vibrated with changes in magnetic flux density as the developing sleeve 2 is rotated, and develops the electrostatic latent image with the toner while passing smoothly through the gap at the developing zone 8. Here, in order to perform the development preferably, a bias voltage may be applied across the developing sleeve and the substrate of the photosensitive drum 1.

The developer having consumed the toner component at the developing zone 8 is further transported in the state in which its carrier concentration has become high, and is again mixed with the developer having a high toner concentration.

In the present invention, employing the constitution as described previously, the charging speed of toner particles is improved and the range of distribution of electric charges in toner can be narrow, thus copied images with a stable image quality can be obtained while maintaining a stable charge quantity. Also, since the carrier has the shape factors within specific ranges, the carrier has a high fluidity and can have more opportunities of contact charging with the toner, so that a developer chargeable uniformly and chargeable at a high speed can be obtained, which is adaptable to agitation at higher speed than ever. Also, the coat layers of carrier particles may come off less frequently and experience less wear. The toner may collide against the carrier with only a small force, and hence the toner may hardly cause its deterioration and the carrier can retain its charge-providing ability over a long period of time.

EXAMPLES

The present invention will be described below in greater detail by the Examples. The present invention is by no means limited to the following Examples.

Production Example of Resin-coated Carrier AA 20 mole % of CuO, 15 mole % of ZnO and 65 mole % of $Fe_2O_3$ were mixed and then pulverized by means of a wet ball mill, followed by granulation using a granulator (spray dryer) and then firing at about 1,190° C. for 8 hours. The resultant fired product was disintegrated, followed by classification to obtain carrier core material AA with a 50% particle diameter of 41 μm. Acryl-modified silicone resin (KR9706, available from Shin-Etsu Chemical Co., Ltd.) was diluted with methyl ethyl ketone (MEK) to prepare a coating solution with a solid content of 5%. Then, 12 parts by weight of this coating solution and 100 parts by weight of the carrier core material AA were mixed, and put into a mixing agitator being able to conduct a drying treatment under reduced pressure and with heating, to coat the core particles with the resin by mixing agitation, followed by heating at 190° C. for 25 minutes to harden the coat resin. Thereafter, the particles thus coated were disintegrated by means of a pulverizer, and then classified using a sieve of 75 μm mesh, further followed by magnetic separation to remove low-magnetic force components, Thus, the resin-coated carrier AA was obtained. The resin-coated carrier AA had shape factors SF-1 of 138 and SF-2 of 124. For measurement, a two component type developer described later, a blend of the resin-coated carrier and a toner was treated with a surface-active agent diluted with pure water, to separate the toner. Thereafter, the remaining carrier was heated to 850° C. in the air then cooled, and thereafter washed with MEK to remove the coat resin (coat layer). The carrier core material after removal of the coat layer had a specific surface area (SW1) of 895 $cm^2/g$.

This resin-coated carrier AA had a specific surface area (SW2) of 592 $cm^2/g$, thus the value of SW1–SW2 was 303 $cm^2/g$.

Production Example of Resin-coated Carriers BB to SS

Carrier core materials BB to SS were obtained in the same manner as in the production of the carrier core material AA except that granulation conditions, firing temperature and classification conditions were changed. Using the carrier core materials BB to SS thus obtained, resin-coated carriers BB to TT were obtained in the same manner as the resin-coated carrier AA except that coating solvent quantity (resin dilution) and coating resin quantity were changed.

Production Example of Resin-coated Carrier UU

A resin-coated carrier UU was obtained in the same manner as in Production Example of Resin-coated Carrier AA except that the coating solution was replaced with a coating solution prepared by adding γ-aminopropylmethyldimethoxysilane in an amount of 12% by weight based on the weight of the resin solid content.

Production Example of Resin-coated Carrier VV

A carrier core material VV was obtained in the same manner as in the production of carrier core material AA except that the materials therefor were replaced with 35 mole % of MnO, 14 mole % of MgO and 1 mole % of $SrCO_3$ and 50 mole % of $Fe_2O_3$, and $Al_2O_3$ was further added in an amount of 0.3 mole % of the whole. A resin-coated carrier VV was obtained in the same manner as the resin-coated carrier AA except that the carrier core material VV obtained was coated with resin using the coating solution used in Production Example of Resin-coated Carrier AA.

Production Example of Resin-coated Carrier WW

A resin-coated carrier WW was obtained in the same manner as in Production Example of Resin-coated Carrier AA except that the carrier core material VV obtained in Production Example of Resin-coated Carrier VV was coated with resin using the coating solution used in Production Example of Resin-coated Carrier UU.

Physical properties of the above resin-coated carriers AA to WW are shown in Tables 1 and 2.

| Production Example of Toner AA | |
|---|---|
| Polyester resin obtained by condensation of propoxidized bisphenol with fumaric acid | 100 parts |
| Phthalocyanine pigment | 5 parts |
| Di-tert-butylsalicylic acid aluminum compound (charge control agent) | 4 parts (by weight) |

The above materials were premixed thoroughly by means of a Henschel mixer, and the mixture obtained was melt-kneaded using a twin-screw extruder, setting temperature at 100° C. The resultant kneaded product was cooled and thereafter crushed into particles of about 1 to 2 mm in diameter by means of a hammer mill. Subsequently, the crushed product was pulverized into particles of 20 μm or smaller in diameter, using a fine grinding mill of an air-jet system. The pulverized product thus obtained was further classified to make a selection so that its volume-average the particle diameter in particle size distribution was 6.1 μm, to obtain cyan toner particles (a classified product). For the purpose of improving fluidity and providing charging properties, 1.5 parts by weight of fine alumina powder hydrophobic-treated with a silicon compound was externally added to 100 parts by weight of the cyan toner particles to obtain cyan toner (AA). The cyan toner thus obtained had a weight-average particle diameter of 6.1 μm.

Production Example of Toners BB & CC

Cyan toners BB and CC having different particle size distributions as shown in Table 3 were obtained by producing them in the same manner as the cyan toner (AA) except that, in Production Example of Toner AA, only classification conditions were changed.

Production Example of Toner DD

A cyan toner (DD) was obtained in the same manner as in Production Example of Toner AA except that fine silica powder hydrophobic-treated with a paratoluene sulfonate of triethylamine was externally added in place of the hydrophobic-treated fine alumina powder.

Production Example of Toners EE to GG

A magenta toner (EE), a yellow toner (FF) and a black toner (GG) were obtained in the same manner as in Production Example of Toner AA except that the phthalocyanine pigment used therein was replaced with a quinacridone pigment, a disazo yellow pigment and carbon black, respectively.

Particle size distributions of the cyan toners (AA) to (DD), the magenta toner (EE), the yellow toner (FF) and the black toner (GG) are shown in Table 3.

Example 1

The resin-coated carrier AA was blended with 6.0 parts by weight of the cyan toner (AA) in an amount giving 100 parts by weight in total, to obtain a two component type developer. In the two component type developer, the toner concentration was 6.0% by weight.

This two component type developer was put in a cyan developing assembly of a color laser copying machine manufactured by CANON INC. (CLC-800, modified to drive at a process speed of 250 mm/sec.), and a running test was conducted to make an evaluation. In this copying test, images formed at the initial stage were very similar to an original and of a good quality.

Cyan color images free of fog and on which the original was faithfully reproduced were also obtained even after running on 80,000 sheets, showing a superior reproducibility. In the copying machine, the developer was well transported and toner concentration in the developer was also well maintained to attain a stable image density.

Charge quantity was measured in each environment of low temperature/low humidity (15° C./10%RH) and high temperature/high humidity (32.5° C./85%RH), where environmental dependence was so low that the charge quantity ratio depending on environment was 1.30.

In Example 1, image density at contrast potential of 400 V was 1.80 (Macbeth reflection density) at the initial stage, and 1.79 after running on 80,000 sheets.

The results of the evaluation are shown in Table 5.

(Evaluation Items)

The evaluation was made in the manner as described below.

(1) Image density (initial stage and after running):

Images were reproduced using the test machine described above, and image densities at the initial stage and after the 80,000-sheet running were measured with a Macbeth densitometer.

(2) Fog:

Fog having occurred on white images (non-image area) was measured with REFLECTOMETER (manufactured by v Tokyo Denshoku K.K). Fog (%) was calculated from the relationship between the whiteness of white background areas having passed through a fixing assembly and the whiteness of transfer paper before passing through the fixing assembly to make an evaluation on the basis of image contamination. The worst value in the course of running inclusive of the initial stage and after the 80,000-sheet running was improved.

(3) Developer transport performance:

Images were reproduced using the test machine described above, and developer coat quantities on the developing sleeve at the initial stage and after the 80,000-sheet running were measured by suction to make an evaluation according to the following criteria.

A (excellent): Little change from the quantity at the initial stage, showing a change in a very small quantity within ±1.0 mg/cm$^2$.

B (good): Little change from the quantity at the initial stage, showing a change in a small quantity within ±2.0 mg/cm$^2$.

C (passable): Showing a change in a small quantity within ±3.0 mg/cm$^2$.

D (poor): Showing a change in a large quantity of more than ±3.0 mg/cm$^2$.

(4) Image density uniformity:

Uniformity of solid images on the same paper was evaluated according to the following criteria (measuring instrument: Macbeth densitometer).

A (very good): Density difference is little (image density difference is within ±0.1).

B (good): A very small drop (image density difference is within ±0.2).

C (passable): Image density difference is within ±0.3.

D (poor): Image density difference is greater than ±0.3.

(5) Toner scatter:

How the neighborhood of the developing assembly stood was visually examined after the running test was completed, to make an evaluation according to the following criteria.

A: Toner scatter is little.

B: Toner scatter is in a very small quantity.

C: Toner scatter is seen, but in a small quantity.

D: Toner scatter is in a large quantity.

Examples 2 to 19 & Comparative Examples 1 to 9

An evaluation was made in the same manner as in Example 1 except that, using resin-coated carriers shown in Tables 1 and 2 and toners shown in Table 3, the combination of the toner with the carrier was changed as shown in Table 4, to obtain the results shown in Table 5.

In Table 5, asterisked Examples 1, 17 and 19 require the following explanations. In Examples 1, 17 and 19, the two component type developers were sampled after the 80,000-sheet running to examine their carrier particle surfaces by FE-SEM (field emission scanning electron microscopy). As a result, in Example 1 the carrier particle surfaces have decreased in coat resin though in a very small quantity compared with their state at the initial stage. In Examples 17 and 18, the carrier particle surfaces after the 80,000-sheet running were in substantially the same state of the coat resin as at the initial stage.

Example 20

Two component type developers 1 to 4 were obtained by blending toners and carriers in combination as shown in Table 6. In the two component type developers, the concentrations were as shown in Table 6.

The above two component type developers 1 to 4 were put in a cyan developing assembly, a magenta developing assembly, a yellow developing assembly and a black developing assembly, respectively, each constructed as shown in FIG. 1, of a color laser copying machine manufactured by CANON INC. (CLC-800, modified to drive at a process speed of 250 mm/sec.), and full-color images were copied. As a result, full-color images having color tones very faithful to originals were obtained, and full-color images were fog-free and the same color tones as the images at the initial stage were obtained also after the 80,000-sheet running.

Production Example of Resin-coated Carrier A 17 mole % of CuO, 18 mole % of ZnO and 65 mole % of $Fe_2O_3$ were mixed and then pulverized by means of a wet ball mill, followed by granulation using a granulator (spray dryer) and then firing at about 1,190° C. for 8 hours. The resultant fired product was disintegrated, followed by classification to obtain carrier core material A with a 50% particle diameter of 40 $\mu$m. Acryl-modified silicone resin (KR9706, available from Shin-Etsu Chemical Co., Ltd.) was diluted with methyl ethyl ketone (MEK) to prepare a coating solution with a solid content of 5%. Then, 15 parts by weight of this coating solution and 100 parts by weight of the carrier core material A were mixed, and put into a mixing agitator able to conduct a drying treatment under reduced pressure and with heating, to coat the core particles with the resin by mixing agitation, followed by heating at 180° C. for 20 minutes to harden the coat resin. Thereafter, the particles thus coated were disintegrated by means of a pulverizer, and then classified using a sieve of 75 $\mu$m mesh, further followed by magnetic separation to remove low-magnetic force components. Thus, the resin-coated carrier A was obtained. The resin-coated carrier A had shape factors SF-1 of 124 and SF-2 of 115. For measurement, a two component type developer described later, a blend of the resin-coated carrier and a toner, was treated with a surface-active agent diluted with pure water, to separate the toner. Thereafter, the remaining carrier was heated to 850° C. in the air and then cooled, and thereafter washed with MEK to remove the coat resin (coat layer). The carrier core material after removal of the coat layer had a specific surface area (SW1) of 920 $cm^2/g$.

This resin-coated carrier A had a specific surface area (SW2) of 608 $cm^2/g$, thus the value of SW1−SW2 was 312 $cm^2/g$.

Production Example of Resin-coated Carriers B to L

Carrier core materials B to L were obtained in the same manner as the carrier core material A except that granulation conditions and the firing temperature were changed. Using the carrier core materials B to L thus obtained, resin-coated carriers B to L were obtained in the same manner as the resin-coated carrier A except that coating solvent quantity (resin dilution) and coating resin quantity were changed.

Production Example of Resin-coated Carriers M & N

Carrier core materials M and N were obtained in the same manner as in the production of carrier core material A except that classification conditions were changed. Using the carrier core materials M and N thus obtained, resin-coated carriers M and N were obtained in the same manner as the resin-coated carrier A.

Production Example of Resin-coated Carrier O

A resin-coated carrier O was obtained in the same manner as in Production Example of Resin-coated Carrier A except that the coating solution was replaced with a coating solution prepared by adding γ-aminopropylmethyldimethoxysilane in an amount of 12% by weight based on the weight of the resin solid content.

Production Example of Resin-coated Carrier P

A carrier core material P was obtained in the same manner as in the production of carrier core material A except that the materials therefor were replaced with 35 mole % of MnO, 14 mole % of MgO and 1 mole % of $SrCO_3$ and 50 mole % of $Fe_2O_3$, and $Al_2O_3$ was further added in an amount of 0.3 mole % of the whole. A resin-coated carrier P was obtained in the same manner as the resin-coated carrier A except that the carrier core material P obtained was coated with resin using the coating solution used in Production Example of Resin-coated Carrier A.

Production Example of Resin-coated Carrier Q

A resin-coated carrier Q was obtained in the same manner as in Production Example of Resin-coated Carrier A except that the carrier core material P obtained in Production Example of Resin-coated Carrier P was coated with resin using the coating solution used in Production Example of Resin-coated Carrier O.

Physical properties of the above resin-coated carriers A to Q are shown in Table 7.

| Production Example of Toner A | |
|---|---|
| Polyester resin obtained by condensation of propoxidized bisphenol with fumaric acid | 100 parts |
| Phthalocyanine pigment | 5 parts |
| Di-tert-butylsalicylic acid aluminum compound (charge control agent) | 4 parts (by weight) |

The above materials were premixed thoroughly by means of a Henschel mixer, and the mixture was melt-kneaded using a twin-screw extruder, setting temperature at 100° C. The resultant kneaded product was cooled and thereafter crushed into particles of about 1 to 2 mm in diameter by means of a hammer mill. Subsequently, the crushed product was pulverized into particles of 20 μm or smaller in diameter, using a fine grinding mill of an air-jet system. The pulverized product thus obtained was further classified to make a selection so that its volume-average the particle diameter in particle size distribution was 5.9 μm, to obtain cyan toner particles (a classified product). For the purpose of improving fluidity and providing charging properties, 1.5 parts by weight of fine alumina powder hydrophobic-treated with a silicon compound was externally added to 100 parts by weight of the cyan toner particles to obtain a cyan toner (A). The cyan toner thus obtained had a weight-average particle diameter of 5.9 μm.

Production Example of Toners B to G

Cyan toners (B) to (G) having different particle size distributions as shown in Table 8 were obtained in the same manner as the cyan toner (A) except that, in Production Example of Toner A, only classification conditions were changed.

Production Example of Toner H

A cyan toner H was obtained in the same manner as in Production Example of Toner A except that fine silica powder hydrophobic-treated with a paratoluene sulfonate of triethylamine was externally added in place of the hydrophobic-treated fine alumina powder.

Production Example of Toners I to K

A magenta toner (I), a yellow toner (J) and a black toner (K) were obtained in the same manner as in Production Example of Toner A except that the phthalocyanine pigment used therein was replaced with a quinacridone pigment, a disazo yellow pigment and carbon black, respectively.

Particle size distributions of the cyan toners (A) to (H), the magenta toner (I), the yellow toner (J) and the black toner (K) are shown in Table 8.

Example 21

The resin-coated carrier A was blended with 6.0 parts by weight of the cyan toner (A) in an amount giving 100 parts by weight in total, to obtain a two component type developer. In the two component type developer, the toner concentration was 6.0% by weight.

This two component type developer was put in a cyan developing assembly of a color laser copying machine manufactured by CANON INC. (CLC-800, modified to drive at a process speed of 200 mm/sec.), and a running test was conducted to make an evaluation. In this copying test, images formed at the initial stage were very similar to an original and of a good quality.

Cyan color images free of fog and on which the original was faithfully reproduced were also obtained even after running on 60,000 sheets, showing a superior reproducibility. In the copying machine, the developer was well transported and toner concentration in the developer was also well maintained to attain a stable image density.

Charge quantity was measured in each environment at low temperature/low humidity (15° C./10%RH) and high temperature/high humidity (32.5° C./85%RH), where environmental dependence was so extremely low that charge quantity ratio was 1.30.

In Example 21, image density at contrast potential of 400 V was 1.83 (Macbeth reflection density).

Using the above developer, its transport performance was evaluated in combination with a developing sleeve of 24.5 mm diameter (developing sleeve T-1; surface-coated with a phenol resin incorporated with carbon particles; surface roughness Rz: 4.0 μm). The X/C, the ratio of toner weight-average particle diameter (D4) X to carrier 50% average particle diameter C, was 14.8. (See Table 10.)

Results obtained after the 60,000-sheet running are shown in Table 11. As will be described later, the developer transport performance evaluated as "A" means that the developer was stably transported in the direction of sleeve rotation and there was little change in the quantity of the developer present on the developing sleeve.

The surface roughness Rz of the developing sleeve is a value obtained by measuring the surface of the developing sleeve in its axial direction by means of SURFCORDER SE-30H, manufactured by Kosaka Kenkyusho.

As can be seen from the results shown in Table 11, the developer transport performance correlates with the developer leak in actual machines. From this result, it has been found very effective when the surface roughness Rz is within the range of:

$$2\times Rz \leqq X/C\times 100 \leqq 11\times Rz.$$

(Evaluation Items)

The evaluation was made in the manner described below.

(1) Image density (initial stage and after running):

Images were reproduced using the test machine described above, and image densities at the initial stage and after the 60,000-sheet running were measured with a Macbeth densitometer.

(2) Fog:

Fog that occurred on white images (non-image area) was measured with REFLECTOMETER (manufactured by Tokyo Denshoku K.K.). Fog (%) was calculated from the relationship between the whiteness of white background areas having passed through a fixing assembly and the whiteness of transfer paper before passing through the fixing assembly to make an evaluation on the basis of image contamination. The worst value in the course of running inclusive of the initial stage and after the 60,000-sheet running was improved.

(3) Developer transport performance:

Images were reproduced using the test machine described above, and developer coat quantities on the developing sleeve at the initial stage and after the 60,000-sheet running were measured by suction to make an evaluation according to the following criteria.

A (excellent): Little change from the quantity at the initial stage, showing a change in a very small quantity within ±1.0 mg/cm$^2$.

B (good): Little change from the quantity at the initial stage, showing a change in a small quantity within ±2.0 mg/cm2.

C (passable): Showing a change in a small quantity within ±3.0 mg/cm$^2$.

D (poor): Showing a change in a large quantity more than ±3.0 mg/cm$^2$.

(4) Developer leak:

After the running test was completed, the state of any developer leak to the lower part of the developing sleeve was examined to make an evaluation according to the following criteria.

A (very good): Fallout is little.

B (good): Fallout is in a very small quantity.

C (passable): Fallout is in a small quantity.

D (poor): Fallout is in a large quantity.

(5) Toner scatter:

How the neighborhood of the developing assembly stood was visually examined after the running test was completed, to make an evaluation according to the following criteria.

A: Toner scatter is little.

B: Toner scatter is in a very small quantity.

C: Toner scatter is seen, but in a small quantity.

D: Toner scatter is in a large quantity.

Examples 22 to 45 & Comparative Examples 10 to 16

An evaluation was made in the same manner as in Example 11 except that, the developing assembly shown in FIG. 1 was used instead of CLC-800 cyan developing assembly used in Example 21, using resin-coated carriers shown in Table 7 and toners shown in Table 8, the developing sleeves shown in Table 9 were used and the developing conditions were changed as shown in Table 10, to obtain the results shown in Table 11.

In Table 11, asterisked Examples 21, 43 and 45 require the following explanations. In Examples 21, 43 and 45, the two component type developers were sampled after the 60,000-sheet running to examine their carrier particle surfaces by FE-SEM (field emission scanning electron microscopy). As a result, in Example 21 the carrier particle surfaces have decreased in coat resin though in a very small quantity compared with their state at the initial stage. In Examples 43 and 45, the carrier particle surfaces after the 60,000-sheet running were in substantially the same state of the coat resin as that at the initial stage.

Example 46

Two component type developers A to D were obtained by blending toners and resin-coated carriers in combination as shown in Table 12. In the two component type developers, the toner concentrations were as shown in Table 12.

The above two component type developers A to D were put in a cyan developing assembly, a magenta developing assembly, a yellow developing assembly and a black developing assembly, respectively, each constructed as shown in FIG. 1, of a color laser copying machine manufactured by CANON INC. (CLC-800, modified to drive at a process speed of 200 mm/sec.), and full-color images were copied. As a result, full-color images having color tones very faithful to originals were obtained, and full-color images fog-free and having the same color tones as the images at the initial stage were obtained also after the 60,000-sheet running.

TABLE 1

| | Carrier Specific Surface Area and Particle Size | | | | | | | |
|---|---|---|---|---|---|---|---|---|
| | Coat layer removed, carrier core | Resin-coated | | | Carrier particles | | | |
| Resin = coated carrier | material specific surface area SW1 (cm$^2$/g) | carrier specific surface area SW2 (cm$^2$/g) | SW1-SW2 (cm$^2$/g) | 50% particle diameter (μm) | Smaller than 22 μm | Smaller than 16 μm (% by number) | Not smaller than 62 μm | Not smaller than 88 μm |
| AA | 895 | 592 | 303 | 41 | 1.2 | 0.2 | 5.8 | 0.1 |
| BB | 1,120 | 793 | 327 | 41 | 1.4 | 0.2 | 5.1 | 0.1 |
| CC | 787 | 598 | 189 | 40 | 1.5 | 0.3 | 5.2 | 0.2 |
| DD | 887 | 735 | 152 | 41 | 1.6 | 0.1 | 5.4 | 0.2 |
| EE | 832 | 743 | 89 | 40 | 1.5 | 0.3 | 6.0 | 0.2 |
| FF | 800 | 744 | 56 | 41 | 1.5 | 0.3 | 6.5 | 0.3 |
| GG | 987 | 595 | 392 | 42 | 1.2 | 0.3 | 6.2 | 0.2 |
| HH | 997 | 552 | 445 | 40 | 1.6 | 0.2 | 5.7 | 0.1 |
| II | 1,105 | 556 | 549 | 43 | 1.3 | 0.4 | 4.7 | 0.4 |
| JJ | 1,125 | 502 | 623 | 40 | 1.5 | 0.6 | 4.5 | 0.4 |
| KK | 1,204 | 502 | 702 | 39 | 1.7 | 0.4 | 6.2 | 0.5 |
| LL | 741 | 566 | 175 | 64 | 0.4 | 0.1 | 31.0 | 6.0 |
| MM | 707 | 409 | 298 | 78 | 0.8 | 0.1 | 55.0 | 21.0 |
| NN | 689 | 551 | 138 | 41 | 1.5 | 0.4 | 5.1 | 0.2 |
| OO | 674 | 506 | 168 | 42 | 1.4 | 0.3 | 5.5 | 0.3 |
| PP | 1,123 | 794 | 329 | 40 | 1.3 | 0.4 | 5.2 | 0.3 |
| QQ | 1,120 | 793 | 327 | 41 | 1.5 | 0.2 | 5.1 | 0.1 |
| RR | 688 | 617 | 71 | 39 | 1.4 | 0.2 | 6.0 | 0.3 |
| SS | 1,122 | 789 | 333 | 41 | 1.0 | 0.3 | 5.5 | 0.2 |
| TT | 672 | 483 | 189 | 59 | 0.1 | 0 | 28.5 | 4.8 |
| UU | 896 | 580 | 316 | 42 | 1.0 | 0.2 | 6.0 | 0.1 |
| VV | 875 | 554 | 321 | 39 | 1.3 | 0.1 | 6.5 | 0.1 |
| WW | 874 | 552 | 322 | 40 | 1.4 | 0.2 | 6.5 | 0.2 |

TABLE 2

| Carrier Shape Factors SF-1 & SF-2 | SF-1 | SF-2 |
|---|---|---|
| Resin-coated carrier AA | 125 | 116 |
| Resin-coated carrier BB | 144 | 120 |
| Resin-coated carrier CC | 126 | 116 |
| Resin-coated carrier DD | 152 | 121 |
| Resin-coated carrier EE | 153 | 123 |
| Resin-coated carrier FF | 127 | 107 |
| Resin-coated carrier GG | 155 | 110 |
| Resin-coated carrier HH | 158 | 142 |
| Resin-coated carrier II | 127 | 116 |
| Resin-coated carrier JJ | 156 | 148 |
| Resin-coated carrier KK | 148 | 119 |
| Resin-coated carrier LL | 126 | 113 |
| Resin-coated carrier MM | 125 | 117 |
| Resin-coated carrier NN | 116 | 102 |
| Resin-coated carrier OO | 106 | 120 |
| Resin-coated carrier PP | 169 | 140 |
| Resin-coated carrier QQ | 155 | 160 |
| Resin-coated carrier RR | 107 | 102 |
| Resin-coated carrier SS | 168 | 160 |
| Resin-coated carrier TT | 124 | 114 |
| Resin-coated carrier UU | 126 | 118 |
| Resin-coated carrier VV | 122 | 113 |
| Resin-coated carrier WW | 123 | 116 |

TABLE 3

| Toner Particle Size Distribution | 4.00 μm or smaller (% by number) | 12.7 μm or larger (% by volume) | Weight-average particle diameter (μm) |
|---|---|---|---|
| Toner (AA) | 7.8 | 0.2 | 6.1 |
| Toner (BB) | 28.0 | 0.2 | 5.3 |
| Toner (CC) | 2.8 | 0.3 | 8.2 |
| Toner (DD) | 8.1 | 0.3 | 6.2 |
| Toner (EE) | 7.6 | 0.2 | 6.1 |
| Toner (FF) | 7.9 | 0.3 | 6.0 |
| Toner (GG) | 8.0 | 0.4 | 6.3 |

TABLE 4

| Toner/Carrier Combination | Toner used | Carrier used |
|---|---|---|
| Example 1 | (AA) | AA |
| Example 2 | (AA) | BB |
| Example 3 | (AA) | CC |
| Example 4 | (AA) | DD |
| Example 5 | (AA) | EE |
| Example 6 | (AA) | GG |
| Example 7 | (AA) | HH |
| Example 8 | (AA) | II |
| Example 9 | (AA) | JJ |
| Example 10 | (AA) | LL |
| Example 11 | (BB) | AA |
| Example 12 | (CC) | AA |
| Example 13 | (BB) | II |
| Example 14 | (BB) | LL |
| Example 15 | (DD) | AA |
| Example 16 | (AA) | TT |
| Example 17 | (AA) | UU |
| Example 18 | (AA) | VV |
| Example 19 | (AA) | WW |
| Comparative Ex. 1 | (AA) | FF |
| Comparative Ex. 2 | (AA) | KK |
| Comparative Ex. 3 | (AA) | MM |
| Comparative Ex. 4 | (AA) | NN |

TABLE 4-continued

| Toner/Carrier Combination | Toner used | Carrier used |
|---|---|---|
| Comparative Ex. 5 | (AA) | OO |
| Comparative Ex. 6 | (AA) | PP |
| Comparative Ex. 7 | (AA) | QQ |
| Comparative Ex. 8 | (AA) | RR |
| Comparative Ex. 9 | (AA) | SS |

TABLE 5

| Evaluation Results | Image density | | | Developer | Image | |
|---|---|---|---|---|---|---|
| | Initial stage | After 80,000 = sheet running | Fog | transport performance | density uniformity | Toner scatter |
| Example: | | | | | | |
| 1* | 1.80 | 1.79 | 0.5 | A | A | A |
| 2 | 1.84 | 1.79 | 0.7 | A | A | A |
| 3 | 1.75 | 1.73 | 0.8 | B | B | A |
| 4 | 1.69 | 1.67 | 1.0 | B | B | A |
| 5 | 1.62 | 1.60 | 1.2 | C | B | A |
| 6 | 1.81 | 1.77 | 1.8 | A | B | B |
| 7 | 1.80 | 1.76 | 2.3 | A | B | C |
| 8 | 1.81 | 1.74 | 2.6 | A | B | C |
| 9 | 1.80 | 1.70 | 2.8 | B | B | C |
| 10 | 1.80 | 1.68 | 0.9 | B | B | B |
| 11 | 1.86 | 1.80 | 2.1 | B | A | B |
| 12 | 1.71 | 1.70 | 0.6 | A | C | A |
| 13 | 1.84 | 1.76 | 2.8 | A | A | C |
| 14 | 1.85 | 1.76 | 1.4 | B | A | B |
| 15 | 1.84 | 1.59 | 2.6 | B | B | C |
| 16 | 1.80 | 1.78 | 1.0 | A | A | B |
| 17* | 1.81 | 1.81 | 0.4 | A | A | A |
| 18 | 1.79 | 1.78 | 0.5 | A | A | A |
| 19* | 1.80 | 1.79 | 0.4 | A | A | A |
| Comparative Example: | | | | | | |
| 1 | 1.46 | 0.91 | 1.2 | B | D | A |
| 2 | 1.79 | 1.61 | 5.3 | D | B | D |
| 3 | 1.78 | 1.47 | 3.6 | B | C | D |
| 4 | 1.85 | 1.05 | 4.6 | B | D | D |
| 5 | 1.80 | 0.97 | 1.8 | A | B | D |
| 6 | 1.78 | 1.80 | 4.8 | D | D | B |
| 7 | 1.72 | 1.74 | 6.1 | C | C | D |
| 8 | 1.85 | 0.84 | 5.2 | B | D | D |
| 9 | 1.75 | 1.79 | 5.3 | D | D | D |

TABLE 6

| Two component type developer | Toner used | Carrier used | Toner concentration (wt. %) |
|---|---|---|---|
| Two component type developer 1 | Cyan toner (AA) | Resin-coated carrier WW | 7.0 |
| Two component type developer 2 | Magenta toner (EE) | Resin-coated carrier WW | 8.0 |
| Two component type developer 3 | Yellow toner (FF) | Resin-coated carrier WW | 8.0 |
| Two component type developer 4 | Black toner (GG) | Resin-coated carrier WW | 8.0 |

TABLE 7

Carrier Specific Surface Area and Particle Size

| Resin = coated carrier | Coat layer removed, carrier core material specific surface area SW1 ($cm^2/g$) | Resin-coated carrier specific surface area SW2 ($cm^2/g$) | SW1-SW2 ($cm^2/g$) | 50% particle diameter ($\mu m$) | Carrier particles: Smaller than 22 $\mu m$ (% by number) | Smaller than 16 $\mu m$ (% by number) | Not smaller than 62 $\mu m$ (% by number) | Not smaller than 88 $\mu m$ (% by number) | Shape factors SF-1 | Shape factors SF-2 |
|---|---|---|---|---|---|---|---|---|---|---|
| A | 920 | 608 | 312 | 40 | 1.6 | 0.2 | 5.0 | 0.1 | 124 | 115 |
| B | 1,254 | 866 | 388 | 41 | 1.5 | 0.3 | 4.9 | 0.1 | 141 | 124 |
| C | 718 | 510 | 208 | 40 | 1.6 | 0.4 | 5.1 | 0.2 | 125 | 112 |
| D | 1,253 | 628 | 625 | 41 | 1.8 | 0.2 | 5.6 | 0.2 | 143 | 119 |
| E | 1,254 | 561 | 693 | 44 | 1.6 | 0.3 | 6.6 | 0.3 | 144 | 115 |
| F | 698 | 612 | 86 | 40 | 1.7 | 0.4 | 6.9 | 0.4 | 117 | 111 |
| G | 697 | 643 | 54 | 39 | 1.6 | 0.3 | 6.8 | 0.3 | 113 | 114 |
| H | 1,184 | 693 | 491 | 39 | 1.8 | 0.3 | 5.5 | 0.3 | 138 | 114 |
| I | 718 | 612 | 106 | 41 | 1.5 | 0.5 | 4.6 | 0.5 | 120 | 113 |
| J | 1,254 | 1,186 | 68 | 40 | 1.5 | 0.6 | 4.5 | 0.4 | 149 | 143 |
| K | 1,001 | 511 | 490 | 42 | 1.4 | 0.7 | 6.0 | 0.6 | 120 | 107 |
| L | 582 | 408 | 174 | 64 | 0.4 | 0.1 | 31.0 | 7.0 | 126 | 118 |
| M | 522 | 412 | 110 | 75 | 0.3 | 0.1 | 53.0 | 17.0 | 122 | 125 |
| N | 651 | 449 | 202 | 61 | 0.1 | 0 | 30.4 | 6.9 | 120 | 115 |
| O | 920 | 603 | 317 | 41 | 1.7 | 0.3 | 6.0 | 0.1 | 125 | 113 |
| P | 945 | 660 | 285 | 42 | 1.5 | 0.2 | 5.2 | 0.2 | 123 | 116 |
| Q | 945 | 657 | 288 | 43 | 1.5 | 0.3 | 4.8 | 0.1 | 124 | 115 |

TABLE 8

Toner Particle Size Distribution

| | 4.00 $\mu m$ or smaller (% by number) | 12.7 $\mu m$ or larger (% by volume) | Weight-average particle diameter ($\mu m$) |
|---|---|---|---|
| Toner (A) | 8.2 | 0.2 | 5.9 |
| Toner (B) | 8.4 | 0.1 | 6.4 |
| Toner (C) | 12.9 | 0.3 | 7.5 |
| Toner (D) | 46.0 | 0.4 | 7.5 |
| Toner (E) | 2.3 | 0.2 | 5.8 |
| Toner (F) | 52.0 | 0.3 | 3.9 |
| Toner (G) | 5.3 | 22.3 | 9.7 |
| Toner (H) | 8.3 | 0.3 | 5.8 |
| Toner (I) | 8.4 | 0.2 | 6.1 |
| Toner (J) | 8.2 | 0.1 | 6.0 |
| Toner (K) | 8.4 | 0.2 | 6.0 |

TABLE 9

Developing Sleeve

| Developing sleeve | Surface roughness Rz ($\mu m$) | Surface material |
|---|---|---|
| T-1 | 4.0 | Carbon-particle-dispersed phenol resin |
| T-2 | 7.0 | Carbon-particle-dispersed phenol resin |
| T-3 | 4.1 | Phenol resin |
| T-4 | 3.9 | SUS stainless steel |
| T-5 | 8.6 | Carbon-particle-dispersed phenol resin |
| T-6 | 1.1 | Carbon-particle-dispersed phenol resin |
| T-7 | 1.1 | SUS stainless steel |

TABLE 10

| | Toner used | Carrier used | Developing sleeve | Developing sleeve Rz (μm) | Toner average particle diameter/carrier average particle diameter ratio (X/C) |
|---|---|---|---|---|---|
| | Developing Conditions | | | | |
| Example: | | | | | |
| 21 | (A) | A | T-1 | 4.0 | 14.8 |
| 22 | (A) | A | T-2 | 7.0 | 14.8 |
| 23 | (A) | A | T-3 | 4.1 | 14.8 |
| 24 | (A) | A | T-4 | 3.9 | 14.8 |
| 25 | (C) | A | T-5 | 8.6 | 18.8 |
| 26 | (A) | L | T-6 | 1.1 | 9.2 |
| 27 | (A) | B | T-1 | 4.0 | 14.4 |
| 28 | (A) | C | T-1 | 4.0 | 14.8 |
| 29 | (A) | D | T-1 | 4.0 | 14.4 |
| 30 | (A) | F | T-1 | 4.0 | 14.8 |
| 31 | (A) | H | T-1 | 4.0 | 15.1 |
| 32 | (A) | I | T-1 | 4.0 | 14.4 |
| 33 | (A) | K | T-1 | 4.0 | 14.0 |
| 34 | (B) | A | T-1 | 4.0 | 16.0 |
| 35 | (C) | A | T-1 | 4.0 | 18.8 |
| 36 | (D) | A | T-1 | 4.0 | 18.8 |
| 37 | (E) | A | T-1 | 4.0 | 14.5 |
| 38 | (F) | A | T-1 | 4.0 | 9.7 |
| 39 | (G) | A | T-1 | 4.0 | 24.3 |
| 40 | (A) | L | T-7 | 1.1 | 9.2 |
| 41 | (H) | A | T-1 | 4.0 | 14.5 |
| 42 | (A) | N | T-1 | 4.0 | 9.5 |
| 43 | (A) | O | T-1 | 4.0 | 14.1 |
| 44 | (A) | P | T-1 | 4.0 | 13.8 |
| 45 | (A) | Q | T-1 | 4.0 | 13.5 |
| Comparative Example: | | | | | |
| 10 | (A) | A | T-5 | 8.6 | 14.8 |
| 11 | (A) | A | T-6 | 1.1 | 14.8 |
| 12 | (A) | A | T-7 | 1.1 | 14.8 |
| 13 | (A) | E | T-1 | 4.0 | 13.4 |
| 14 | (A) | G | T-1 | 4.0 | 15.1 |
| 15 | (A) | J | T-1 | 4.0 | 14.8 |
| 16 | (A) | M | T-1 | 4.0 | 7.9 |

TABLE 11

| | Evaluation Results | | | | | |
|---|---|---|---|---|---|---|
| | Image density | | | Developer | | |
| | Initial stage | After 60,000 = sheet running | Fog | transport performance | Developer leak | Toner scatter |
| Example: | | | | | | |
| 21* | 1.83 | 1.82 | 0.6 | A | A | A |
| 22 | 1.85 | 1.79 | 0.7 | A | A | B |

TABLE 11-continued

| | Evaluation Results | | | | | |
|---|---|---|---|---|---|---|
| | Image density | | | Developer | | |
| | Initial stage | After 60,000 = sheet running | Fog | transport performance | Developer leak | Toner scatter |
| 23 | 1.88 | 1.76 | 0.9 | B | B | A |
| 24 | 1.88 | 1.77 | 1.1 | B | B | B |
| 25 | 1.87 | 1.80 | 1.5 | C | C | B |
| 26 | 1.81 | 1.64 | 0.8 | B | B | A |
| 27 | 1.90 | 1.78 | 0.3 | A | A | A |
| 28 | 1.74 | 1.66 | 0.5 | A | B | B |
| 29 | 1.88 | 1.84 | 1.7 | B | A | C |
| 30 | 1.72 | 1.60 | 0.9 | B | B | A |
| 31 | 1.86 | 1.80 | 1.9 | B | A | C |
| 32 | 1.71 | 1.60 | 0.6 | C | C | A |
| 33 | 1.86 | 1.76 | 1.6 | C | B | A |
| 34 | 1.88 | 1.60 | 1.4 | A | B | A |
| 35 | 1.69 | 1.79 | 1.6 | A | A | B |
| 36 | 1.88 | 1.78 | 0.9 | B | B | C |
| 37 | 1.80 | 1.70 | 1.2 | B | A | B |
| 38 | 1.88 | 1.76 | 1.5 | B | A | C |
| 39 | 1.86 | 1.76 | 1.6 | B | B | A |
| 40 | 1.75 | 1.60 | 0.8 | C | C | A |
| 41 | 1.84 | 1.58 | 2.1 | C | B | C |
| 42 | 1.83 | 1.77 | 1.3 | A | A | B |
| 43* | 1.84 | 1.84 | 0.5 | A | A | A |
| 44 | 1.80 | 1.80 | 0.6 | A | A | A |
| 45* | 1.82 | 1.82 | 0.4 | A | A | A |
| Comparative Example: | | | | | | |
| 10 | 1.86 | 1.71 | 3.2 | D | D | C |
| 11 | 1.79 | 1.51 | 2.3 | D | B | D |
| 12 | 1.48 | 1.47 | 2.6 | D | B | D |
| 13 | 1.85 | 1.55 | 4.6 | D | C | D |
| 14 | 1.50 | 1.19 | 0.8 | D | D | B |
| 15 | 1.68 | 1.16 | 2.0 | D | D | B |
| 16 | 1.72 | 1.24 | 3.1 | D | D | C |

TABLE 12

| Two component type developer | Toner used | Carrier used | Toner concentration (wt. %) |
|---|---|---|---|
| Two component type developer A | Cyan toner A | Resin-coated carrier Q | 7.0 |
| Two component type developer B | Magenta toner I | Resin-coated carrier Q | 8.0 |
| Two component type developer C | Yellow toner J | Resin-coated carrier Q | 8.0 |
| Two component type developer D | Black toner K | Resin-coated carrier Q | 8.0 |

What is claimed is:

1. A resin-coated carrier for two component type developers, comprising;

carrier particles having a carrier core material and a coat layer which covers the surface of the carrier core material;

said resin-coated carrier having a 50% particle diameter C ($D_{50}$) of from 25 μm to 70 μm, containing carrier particles smaller than 22 μm in particle diameter in an amount of from 0.1% by number to 20% by number and containing carrier particles of 62 μm or larger in particle diameter in an amount of from 2% by number to 35% by number; and said carrier core material having a BET specific surface area SW1 where the coat layer has been removed and said resin-coated carrier having a BET specific surface area SW2, the SW1 and SW2 satisfying the following expression (I), and said resin-coated carrier satisfying a shape factor SF-1 of the following expression (II) and a shape factor SF-2 of the following expression (III), $$80 \leqq SW1-SW2 \leqq 650 (cm^2/g) \quad (I)$$

$$110 \leqq SF\text{-}1 \leqq 160 \quad (II)$$

$$105 \leqq SF\text{-}2 \leqq 150 \quad (III).$$

2. The resin-coated carrier according to claim 1, wherein said resin-coated carrier has as the shape factors SF-1 of from 115 to 150 and SF-2 of from 110 to 140.

3. The resin-coated carrier according to claim 1, wherein said resin-coated carrier has as the shape factors SF-1 of from 125 to 145 and SF-2 of from 115 to 140.

4. The resin-coated carrier according to claim 1, wherein said resin-coated carrier is a resin-coated carrier having a 50% particle diameter C ($D_{50}$) of from 25 μm to 70 μm, containing carrier particles smaller than 22 μm in particle diameter in an amount of from 0.4% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less.

5. The resin-coated carrier according to claim 1, wherein said resin-coated carrier is a resin-coated carrier having a 50% particle diameter C ($D_{50}$) of from 25 μm to 70 μm, containing carrier particles smaller than 22 μm in particle diameter in an amount of from 1.0% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less.

6. The resin-coated carrier according to claim 1, wherein the BET specific surface area SW1 of the carrier core material where the coat layer has been removed and the BET specific surface area SW2 of the resin-coated carrier satisfy the following expression (IV), $$100 \leqq SW1-SW2 \leqq 520 (cm^2/g) \quad (IV).$$

7. The resin-coated carrier according to claim 1, wherein the BET specific surface area SW1 of the carrier core material where the coat layer has been removed and the BET specific surface area SW2 of the resin-coated carrier satisfy the following expression (V), $$100 \leqq SW1-SW2 \leqq 500 (cm^2/g) \quad (V).$$

8. The resin-coated carrier according to claim 1, wherein the BET specific surface area SW1 of the carrier core material where the coat layer has been removed and the BET specific surface area SW2 of the resin-coated carrier satisfy the following expression (VI), $$150 \leqq SW1-SW2 \leqq 450 (cm^2/g) \quad (VI).$$

9. The resin-coated carrier according to claim 1, wherein the BET specific surface area SW1 of the carrier core material where the coat layer has been removed and the BET specific surface area SW2 of the resin-coated carrier satisfy the following expression (VII), $$180 \leqq SW1-SW2 \leqq 400 (cm^2/g) \quad (VII).$$

10. The resin-coated carrier according to claim 1, wherein the BET specific surface area SW1 of the carrier core material where the coat layer has been removed is from 600 $cm^2/g$ to 1,300 $cm^2/g$.

11. The resin-coated carrier according to claim 1, wherein the BET specific surface area SW1 of the carrier core material where the coat layer has been removed is from 700 $cm^2/g$ to 1,050 $cm^2/g$.

12. The resin-coated carrier according to claim 1, wherein the BET specific surface area SW2 of the resin-coated carrier is from 450 $cm^2/g$ to 1,000 $cm^2/g$.

13. The resin-coated carrier according to claim 1, wherein the BET specific surface area SW2 of the resin-coated carrier is from 500 $cm^2/g$ to 900 $cm^2/g$.

14. The resin-coated carrier according to claim 1, wherein said carrier core material comprises ferrite particles.

15. The resin-coated carrier according to claim 14, wherein said ferrite particles have composition represented by the following general formula:

$$(MnO)_x(MgO)_y(Fe_2O_3)_z$$

wherein x+y+z=100 mole %; and part of MnO, MgO and $Fe_2O_3$ is substituted with at least SrO or $SnO_2$.

16. The resin-coated carrier according to claim 1, wherein said coat layer comprises a silicone resin.

17. The resin-coated carrier according to claim 16, wherein said silicone resin comprises an alkoxysiloxane represented by the following formula,

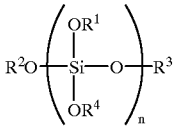

wherein $R^1$, $R^2$, $R^3$ and $R^4$ each represent an alkyl group having 1 to 4 carbon atoms, and n represents an integer of 2 or more.

18. The resin-coated carrier according to claim 17, wherein said silicone resin further comprises a silane coupling agent.

19. The resin-coated carrier according to claim 1, wherein said coat layer has a coating weight of from 0.1% by weight to 5.0% by weight based on the weight of the carrier core material.

20. The resin-coated carrier according to claim 1, wherein said coat layer has a coating weight of from 0.1% by weight to 3.3% by weight based on the weight of the carrier core material.

21. A two component type developer comprising a toner and a resin-coated carrier;

said resin-coated carrier comprising carrier particles having a carrier core material and a coat layer which covers the surface of the carrier core material;

said resin-coated carrier having a 50% particle diameter C ($D_{50}$) of from 25 μm to 70 μm, containing carrier particles smaller than 22 μm in particle diameter in an amount of from 0.1% by number to 20% by number and containing carrier particles of 62 μm or larger in particle diameter in an amount of from 2% by number to 35% by number; and said carrier core material having a BET specific surface area SW1 where the coat layer has been removed and said resin-coated carrier having a BET specific surface area SW2, the SW1 and SW2 satisfying the following expression (I), and said resin-coated carrier satisfying a shape factor SF-1 of the following expression (II) and a shape factor SF-2 of the following expression (III), $$80 \leqq SW1-SW2 \leqq 650 (cm^2/g) \quad (I)$$

$$110 \leqq SF\text{-}1 \leqq 160 \quad (II)$$

$$105 \leqq SF\text{-}2 \leqq 150 \quad (III).$$

22. The two component type developer according to claim 21, wherein said resin-coated carrier has as the shape factors SF-1 of from 115 to 150 and SF-2 of from 110 to 140.

23. The two component type developer according to claim 21, wherein said resin-coated carrier has as the shape factors SF-1 of from 125 to 145 and SF-2 of from 115 to 140.

24. The two component type developer according to claim 21, wherein said resin-coated carrier is a resin-coated carrier having a 50% particle diameter C ($D_{50}$) of from 25 μm to 70 μm, containing carrier particles smaller than 22 μm in particle diameter in an amount of from 0.4% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less.

25. The two component type developer according to claim 21, wherein said resin-coated carrier is a resin-coated carrier having a 50% particle diameter C ($D_{50}$) of from 25 μm to 70 μm, containing carrier particles smaller than 22 μm in particle diameter in an amount of from 1.0% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less.

26. The two component type developer according to claim 21, wherein the BET specific surface area SW1 of the carrier core material where the coat layer has been removed and the BET specific surface area SW2 of the resin-coated carrier satisfy the following expression (IV), $$100 \leqq SW1-SW2 \leqq 520 (cm^2/g) \quad (IV).$$

27. The two component type developer according to claim 21, wherein the BET specific surface area SW1 of the carrier core material where the coat layer has been removed and the BET specific surface area SW2 of the resin-coated carrier satisfy the following expression (V), $$100 \leqq SW1-SW2 \leqq 500 (cm^2/g) \quad (V).$$

28. The two component type developer according to claim 21, wherein the BET specific surface area SW1 of the carrier core material where the coat layer has been removed and the BET specific surface area SW2 of the resin-coated carrier satisfy the following expression (VI), $$150 \leqq SW1-SW2 \leqq 450 (cm^2/g) \quad (VI).$$

29. The two component type developer according to claim 21, wherein the BET specific surface area SW1 of the carrier core material where the coat layer has been removed and the BET specific surface area SW2 of the resin-coated carrier satisfy the following expression (VII), $$180 \leqq SW1-SW2 \leqq 400 (cm^2/g) \quad (VII).$$

30. The two component type developer according to claim 21, wherein the BET specific surface area SW1 of the carrier core material where the coat layer has been removed is from 600 $cm^2/g$ to 1,300 $cm^2/g$.

31. The two component type developer according to claim 21, wherein the BET specific surface area SW1 of the carrier core material where the coat layer has been removed is from 700 $cm^2/g$ to 1,050 $cm^2/g$.

32. The two component type developer according to claim 21, wherein the BET specific surface area SW2 of the resin-coated carrier is from 450 $cm^2/g$ to 1,000 $cm^2/g$.

33. The two component type developer according to claim 21, wherein the BET specific surface area SW2 of the resin-coated carrier is from 500 $cm^2/g$ to 900 $cm^2/g$.

34. The two component type developer according to claim 21, wherein said carrier core material comprises ferrite particles.

35. The two component type developer according to claim 34, wherein said ferrite particles have composition represented by the following general formula:

$$(MnO)_x(MgO)_y(Fe_2O_3)_z$$

wherein x+y+z=100 mole %; and part of MnO, MgO and $Fe_2O_3$ is substituted with at least SrO or $SnO_2$.

36. The two component type developer according to claim 21, wherein said coat layer comprises a silicone resin.

37. The two component type developer according to claim 36, wherein said silicone resin comprises an alkoxysiloxane represented by the following formula,

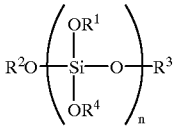

wherein $R^1$, $R^2$, $R^3$ and $R^4$ each represent an alkyl group having 1 to 4 carbon atoms, and n represents an integer of 2 or more.

38. The two component type developer according to claim 37, wherein said silicone resin further comprises a silane coupling agent.

39. The two component type developer according to claim 21, wherein in said resin-coated carrier the coat layer has a coating weight of from 0.1% by weight to 5.0% by weight based on the weight of the carrier core material.

40. The two component type developer according to claim 21, wherein in said resin-coated carrier the coat layer has a coating weight of from 0.1% by weight to 3.3% by weight based on the weight of the carrier core material.

41. The two component type developer according to claim 21, wherein, where the weight-average particle diameter (D4) is represented by X (μm) and the number-based, percent by number of toner particles of 4.00 μm or smaller in particle diameter determined from number distribution is represented by Y (% by number), said toner has a particle size distribution fulfilling the following conditions:

$-4X+30 \leqq Y \leqq -16X+155$; and $3.5 \leqq X \leqq 8.5$.;

42. The two component type developer according to claim 21, wherein fine silica powder, fine titanium oxide powder, fine aluminum oxide powder or a mixture of any of these is externally added to said toner.

43. The two component type developer according to claim 21, wherein fine titanium oxide powder, fine aluminum oxide powder or a mixture of any of these is externally added to said toner.

44. The two component type developer according to claim 43, wherein the fine titanium oxide powder, the fine aluminum oxide powder or the mixture of any of these has been subjected to hydrophobic treatment.

45. A developing method comprising the steps of;

rotating a developing sleeve carrying thereon a two component type developer having a toner and a carrier; and developing an electrostatic latent image formed on the surface of a photosensitive member, by the use of the toner of the two component type developer;

wherein a resin-coated carrier comprising carrier particles having a carrier core material and a coat layer which covers the surface of the carrier core material is used as said carrier;

said resin-coated carrier having a 50% particle diameter C ($D_{50}$) of from 25 μm to 70 μm, containing carrier particles smaller than 22 μm in particle diameter in an amount of from 0.1% by number to 20% by number and containing carrier particles of 62 μm or larger in particle diameter in an amount of from 2% by number to 35% by number; and said carrier core material having a BET specific surface area SW1 where the coat layer has been removed and said resin-coated carrier having a BET specific surface area SW2, the SW1 and SW2 satisfying the following expression (I), and said resin-coated carrier satisfying a shape factor SF-1 of the following expression (II) and a shape factor SF-2 of the following expression (III)

$$80 \leqq SW1-SW2 \leqq 650 (cm^2/g) \quad (I)$$

$$110 \leqq SF\text{-}1 \leqq 160 \quad (II)$$

$$105 \leqq SF\text{-}2 \leqq 150 \quad (III).$$

46. The developing method according to claim 45, wherein said resin-coated carrier has as the shape factors SF-1 of from 115 to 150 and SF-2 of from 110 to 140.

47. The developing method according to claim 45, wherein said resin-coated carrier has as the shape factors SF-1 of from 125 to 145 and SF-2 of from 115 to 140.

48. The developing method according to claim 45, wherein said resin-coated carrier is a resin-coated carrier having a 50% particle diameter C ($D_{50}$) of from 25 μm to 70 μm, containing carrier particles smaller than 22 μm in particle diameter in an amount of from 0.4% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less.

49. The developing method according to claim 45, wherein said resin-coated carrier is a resin-coated carrier having a 50% particle diameter C ($D_{50}$) of from 25 μm to 70 μm, containing carrier particles smaller than 22 μm in particle diameter in an amount of from 1.0% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less.

50. The developing method according to claim 45, wherein the BET specific surface area SW1 of the carrier core material where the coat layer has been removed and the BET specific surface area SW2 of the resin-coated carrier satisfy the following expression (IV), $$100 \leqq SW1-SW2 \leqq 520 (cm^2/g) \quad (IV).$$

51. The developing method according to claim 45, wherein the BET specific surface area SW1 of the carrier core material where the coat layer has been removed and the BET specific surface area SW2 of the resin-coated carrier satisfy the following expression (V), $$100 \leqq SW1-SW2 \leqq 500 (cm^2/g) \quad (V).$$

52. The developing method according to claim 45, wherein the BET specific surface area SW1 of the carrier core material where the coat layer has been removed and the BET specific surface area SW2 of the resin-coated carrier satisfy the following expression (VI), $$150 \leqq SW1-SW2 \leqq 450 (cm^2/g) \quad (VI).$$

53. The developing method according to claim 45, wherein the BET specific surface area SW1 of the carrier core material where the coat layer has been removed and the BET specific surface area SW2 of the resin-coated carrier satisfy the following expression (VII), $$180 \leqq SW1-SW2 \leqq 400 (cm^2/g) \quad (VII).$$

54. The developing method according to claim 45, wherein the BET specific surface area SW1 of the carrier core material where the coat layer has been removed is from 600 $cm^2/g$ to 1,300 $cm^2/g$.

55. The developing method according to claim 45, wherein the BET specific surface area SW1 of the carrier core material where the coat layer has been removed is from 700 $cm^2/g$ to 1,050 $cm^2/g$.

56. The developing method according to claim 45, wherein the BET specific surface area SW2 of the resin-coated carrier is from 450 $cm^2/g$ to 1,000 $cm^2/g$.

57. The developing method according to claim 45, wherein the BET specific surface area SW2 of the resin-coated carrier is from 500 $cm^2/g$ to 900 $cm^2/g$.

58. The developing method according to claim 45, wherein said carrier core material comprises ferrite particles.

59. The developing method according to claim 58, wherein said ferrite particles have composition represented by the following general formula:

$$(MnO)_x(MgO)_y(Fe_2O_3)_z$$

wherein x+y+z=100 mole %; and part of MnO, MgO and $Fe_2O_3$ is substituted with at least SrO or $SnO_2$.

60. The developing method according to claim 45, wherein said coat layer comprises a silicone resin.

61. The developing method according to claim 60, wherein said silicone resin comprises an alkoxysiloxane represented by the following formula,

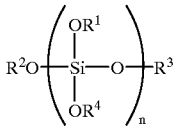

wherein $R^1$, $R^2$, $R^3$ and $R^4$ each represent an alkyl group having 1 to 4 carbon atoms, and n represents an integer of 2 or more.

62. The developing method according to claim 61, wherein said silicone resin further comprises a silane coupling agent.

63. The developing method according to claim 45, wherein in said resin-coated carrier the coat layer has a coating weight of from 0.1% by weight to 5.0% by weight based on the weight of the carrier core material.

64. The developing method according to claim 45, wherein in said resin-coated carrier the coat layer has a coating weight of from 0.1% by weight to 3.3% by weight based on the weight of the carrier core material.

65. The developing method according to claim 45, wherein, where the weight-average particle diameter (D4) is represented by X (μm) and the number-based, percent by number of toner particles of 4.00 μm or smaller in particle diameter determined from number distribution is represented by Y (% by number), said toner has a particle size distribution fulfilling the following conditions:

$-4X+30 \leqq Y \leqq -16X+155$; and $3.5 \leqq X \leqq 8.5$.;

66. The developing method according to claim 45, wherein fine silica powder, fine titanium oxide powder, fine aluminum oxide powder or a mixture of any of these is externally added to said toner.

67. The developing method according to claim 45, wherein fine titanium oxide powder, fine aluminum oxide powder or a mixture of any of these is externally added to said toner.

68. The developing method according to claim 67, wherein the fine titanium oxide powder, the fine aluminum oxide powder or the mixture of any of these has been subjected to hydrophobic treatment.

69. The developing method according to claim 45, wherein the BET specific surface area SW1 of the carrier core material where the coat layer has been removed and the BET specific surface area SW2 of the resin-coated carrier satisfy the following expression (I), and the surface roughness Rz of said developing sleeve, and X/C, which is the ratio of toner weight-average particle diameter (D4) X to carrier 50% average particle diameter C, satisfy the following expression (VIII), $$80 \leqq SW1-SW2 \leqq 650(cm^2/g) \quad (I)$$

$$2 \times Rz \leqq X/C \times 100 \leqq 11 \times Rz \quad (VIII).$$

70. The developing method according to claim 45, wherein;

said resin-coated carrier is a resin-coated carrier having a 50% particle diameter C ($D_{50}$) of from 25 μm to 70 μm, containing carrier particles smaller than 22 μm in particle diameter in an amount of from 0.4% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less; and the BET specific surface area SW1 of the carrier core material where the coat layer has been removed and the BET specific surface area SW2 of the resin-coated carrier satisfy the following expression (I), and the surface roughness Rz of said developing sleeve, and X/C, which is the ratio of toner weight-average particle diameter (D4) X to carrier 50% average particle diameter C, satisfy the following expression (VIII), $$80 \leqq SW1-SW2 \leqq 650(cm^2/g) \quad (I)$$

$$2 \times Rz \leqq X/C \times 100 \leqq 11 \times Rz \quad (VIII).$$

71. The developing method according to claim 45, wherein;

said resin-coated carrier is a resin-coated carrier having a 50% particle diameter C ($D_{50}$) of from 25 μm to 70 μm, containing carrier particles smaller than 22 μm in particle diameter in an amount of from 1.0% by number to 20% by number, containing carrier particles smaller than 16 μm in particle diameter in an amount of 3% by number or less, containing carrier particles of 62 μm or larger in particle diameter in an amount of from 2% by number to 35% by number, and containing carrier particles of 88 μm or larger in particle diameter in an amount of 10% by number or less; and the BET specific surface area SW1 of the carrier core material where the coat layer has been removed and the BET specific surface area SW2 of the resin-coated carrier satisfy the following expression (I), and the surface roughness Rz of said developing sleeve, and X/C, which is the ratio of toner weight-average particle diameter (D4) X to carrier 50% average particle diameter C, satisfy the following expression (VIII), $$80 \leqq SW1-SW2 \leqq 650(cm^2/g) \quad (I)$$

$$2 \times Rz \leqq X/C \times 100 \leqq 11 \times Rz \quad (VIII).$$

72. The developing method according to claim 45, wherein the surface roughness Rz of said developing sleeve, and X/C, which is the ratio of toner weight-average particle diameter (D4) X to carrier 50% average particle diameter C, satisfy the following expression (IX), $$2 \times Rz \leqq X/C \times 100 \leqq 8 \times Rz \quad (IX).$$

73. The developing method according to claim 45, wherein said developing sleeve comprises a non-magnetic sleeve formed of a non-magnetic material and a resin coat layer that covers the surface of the non-magnetic sleeve.

74. The developing method according to claim 73, wherein said resin coat layer contains conductive particles dispersed therein.

* * * * *

UNITED STATES PATENT AND TRADEMARK OFFICE

CERTIFICATE OF CORRECTION

PATENT NO. : 6,146,801
DATED : November 14, 2000
INVENTOR(S) : Yasuhiro Ichikawa et al.

It is certified that error appears in the above-identified patent and that said Letters Patent is hereby corrected as shown below:

Column 1,
Line 62, "to to" should read -- to --.

Column 3,
Line 51, "long" should be deleted.

Column 4,
Line 50, "are" should be deleted.

Column 6,
Line 39, "FIGURE" should read -- The figure --; and
Line 48, "from" should read -- from the --.

Column 7,
Line 2, "toner;" should read -- toner, --;
Line 12, "this" should read -- the --; and
Line 55, "this" should read -- the --.

Column 12,
Line 20, "used" should read -- used, --; and
Line 52, "a" should read -- an --.

Column 14,
Line 14, "well" should be deleted;
Line 23, "determined" should read -- determine --; and
Line 51, "to" should read -- to the --.

Column 15,
Line 20, "to" should read -- and --.

Column 18,
Line 6, "triallylt-" should read -- triallyltri --.

Column 19,
Line 64, "much" should be deleted.

Column 20,
Line 55, "mills," should read -- mills), --.

UNITED STATES PATENT AND TRADEMARK OFFICE

CERTIFICATE OF CORRECTION

PATENT NO. : 6,146,801
DATED : November 14, 2000
INVENTOR(S) : Yasuhiro Ichikawa et al.

It is certified that error appears in the above-identified patent and that said Letters Patent is hereby corrected as shown below:

Column 22,
Line 18, "components," should read -- components. --.
Line 25, "air" should read -- air, --.

Column 23,
Line 26, "the" should be deleted; and
Line 27, "in" should read -- in the --.

Column 24,
Line 34, "v Tokyo" should read -- Tokyo --.

Column 25,
Line 30, "concen-" should read -- toner concen --.

Column 27,
Line 22, "the" should be deleted; and
Line 23, "in" should read -- in the --.

Column 29,
Line 3, "mg/cm2." should read -- $mg/cm^2$. --.

Column 41,
Line 8, "$3.5 \leq X \leq 8.5$.;" should read -- $3.5 \leq X \leq 8.5$. --; and
Line 44, "(III)" should read -- (III), --.

UNITED STATES PATENT AND TRADEMARK OFFICE

CERTIFICATE OF CORRECTION

PATENT NO. : 6,146,801
DATED : November 14, 2000
INVENTOR(S) : Yasuhiro Ichikawa et al.

It is certified that error appears in the above-identified patent and that said Letters Patent is hereby corrected as shown below:

Column 43,
Line 32, "$3.5 \leq X \leq 8.5.$;" should read -- $3.5 \leq X \leq 8.5.$ --

Signed and Sealed this

Twenty-fifth Day of December, 2001

*Attest:*

*Attesting Officer*

JAMES E. ROGAN
*Director of the United States Patent and Trademark Office*